US010336099B2

(12) United States Patent
Yanase et al.

(10) Patent No.: US 10,336,099 B2
(45) Date of Patent: Jul. 2, 2019

(54) FABRIC HOLDER, HEATER, AND IMAGE APPLIER

(71) Applicants: Norikazu Yanase, Kanagawa (JP); Tsuguyori Kemma, Kanagawa (JP); Kohei Chubachi, Tokyo (JP)

(72) Inventors: Norikazu Yanase, Kanagawa (JP); Tsuguyori Kemma, Kanagawa (JP); Kohei Chubachi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/946,787

(22) Filed: Apr. 6, 2018

(65) Prior Publication Data

US 2018/0313033 A1 Nov. 1, 2018

(30) Foreign Application Priority Data

May 1, 2017 (JP) ..... 2017-091057
Jun. 30, 2017 (JP) ..... 2017-129313

(51) Int. Cl.

| | |
|---|---|
| ***B41J 3/407*** | (2006.01) |
| ***B41J 11/00*** | (2006.01) |
| ***B41F 15/12*** | (2006.01) |
| ***B41F 16/02*** | (2006.01) |
| ***B41J 11/06*** | (2006.01) |

(Continued)

(52) U.S. Cl.

CPC ..... *B41J 3/4078* (2013.01); *B41F 15/12* (2013.01); *B41F 16/02* (2013.01); *B41J 11/002* (2013.01); *B41J 11/06* (2013.01); *H05B 3/20* (2013.01); *D06P 5/30* (2013.01)

(58) Field of Classification Search

CPC ..... D06P 5/2077; D06P 5/003; D06P 5/30; B41J 11/58; B41J 11/002; B41J 3/4078; B41J 11/06; B41M 7/009; B41F 15/12; B41F 16/02; H05B 3/20

See application file for complete search history.

(56) References Cited

U.S. PATENT DOCUMENTS

2003/0197772 A1* 10/2003 Iwatsuki ..... B41J 3/4078 347/104
2007/0103529 A1 5/2007 Pearl et al.

(Continued)

FOREIGN PATENT DOCUMENTS

JP 2002-096453 4/2002
JP 2003-312069 11/2003

(Continued)

OTHER PUBLICATIONS

Extended European Search Report dated Sep. 4, 2018 in Patent Application No. 18166168.7, citing documents AA-AE and AO therein, 6 pages.

(Continued)

*Primary Examiner* — Yaovi M Ameh

(74) *Attorney, Agent, or Firm* — Oblon, McClelland, Maier & Neustadt, L.L.P.

(57) ABSTRACT

A fabric holder includes a platen to hold a portion of a fabric to be printed, and a peripheral cover including a frame to sandwich the fabric between the platen and the frame. The fabric holder is detachably attachable to a heating device that heats the fabric, and the peripheral cover includes a heat insulator having a thermal conductivity lower than a thermal conductivity of the peripheral cover.

20 Claims, 22 Drawing Sheets

(51) Int. Cl.
*H05B 3/20* (2006.01)
*D06P 5/30* (2006.01)

(56) References Cited

U.S. PATENT DOCUMENTS

| | | | | |
|---|---|---|---|---|
| 2007/0261568 | A1* | 11/2007 | Smothers | A47J 37/10 99/424 |
| 2013/0076814 | A1* | 3/2013 | Kanaya | B41J 3/4078 347/9 |
| 2015/0273866 | A1 | 10/2015 | Sakai | |
| 2016/0220057 | A1 | 8/2016 | Smith et al. | |
| 2016/0243852 | A1 | 8/2016 | Hamada | |
| 2017/0266984 | A1 | 9/2017 | Hamada | |
| 2017/0320316 | A1 | 11/2017 | Nakamura et al. | |

FOREIGN PATENT DOCUMENTS

| | | | |
|---|---|---|---|
| JP | 2015-183331 | | 10/2015 |
| WO | WO2008/078386 | A1 | 7/2008 |
| WO | WO 2016/123298 | A1 | 8/2016 |

OTHER PUBLICATIONS

U.S. Appl. No. 15/730,925, filed Oct. 12, 2017, Hiroyoshi Matsumoto.
U.S. Appl. No. 15/783,492, filed Oct. 13, 2017, Satoshi Kunioka.
U.S. Appl. No. 15/814,460, filed Nov. 16, 2017, Satoshi Ueno, et al.

* cited by examiner

FABRIC HOLDER, HEATER, AND IMAGE APPLIER

CROSS-REFERENCE TO RELATED APPLICATIONS

This patent application is based on and claims priority pursuant to 35 U.S.C. § 119(a) to Japanese Patent Application No. 2017-091057, filed on May 1, 2017, and Japanese Patent Application No. 2017-129313, filed on Jun. 30, 2017, in the Japan Patent Office, the entire disclosure of each of which is hereby incorporated by reference herein.

BACKGROUND

Technical Field

Aspects of the present disclosure generally relate to a fabric holder, a heater, and an image applier.

Related Art

A textile printing apparatus is known that includes a pre-treatment applier, a press, a printing liquid discharger, and a heater (see, for example, JP-2015-183331-A). The pre-treatment applier applies a pre-treatment agent to a textile medium to be printed. The press compresses the textile medium, which is coated with a pre-treatment agent, while heating the textile medium. The printing liquid discharger discharges the printing liquid to the textile medium that is heated and compressed by the press. The heater heats the textile medium onto which the printing liquid is discharged.

However, the conventional textile printing apparatus has a problem in that the size of the textile printing apparatus increases. A configuration in which the pre-treatment applier, the press, the printing liquid discharger, and the heater for fixing are included in one apparatus has a problem that requires a configuration for stricter cooling and heat insulation with an increase in necessary temperature and heating time.

SUMMARY

In an aspect of this disclosure, a fabric holder includes a platen to hold a portion of a fabric to be printed, and a peripheral cover including a frame to sandwich the fabric between the platen and the frame. The fabric holder is detachably attachable to a heating device that heats the fabric, and the peripheral cover includes a heat insulator having a thermal conductivity lower than a thermal conductivity of the peripheral cover.

In another aspect of this disclosure, the heating device as described above accommodates the fabric holder and includes a heater to heat the fabric held by the fabric holder.

In still another aspect of this disclosure, an image applier including the fabric holder as described above further includes a printer to perform printing on the fabric held by the fabric holder. The fabric holder holding the fabric is detachably attachable to the printer and the heating device.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
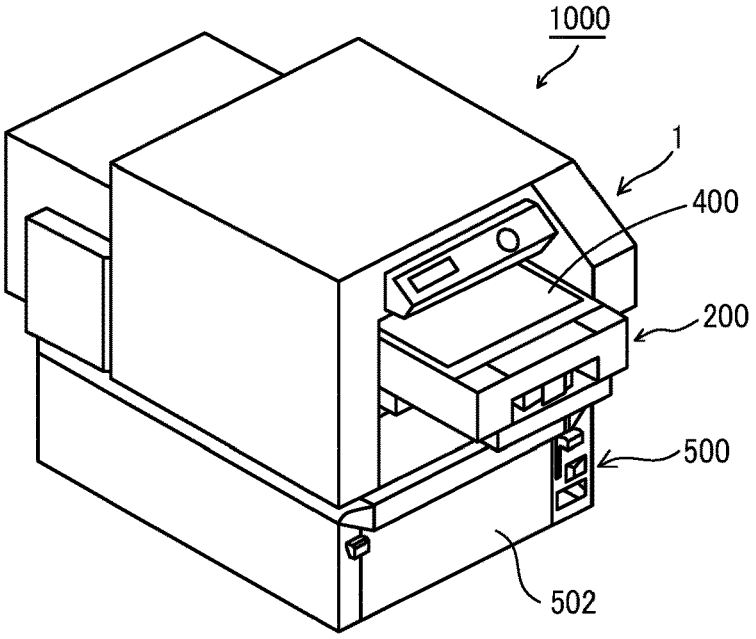
FIG. 1 is a schematic perspective view of an image applier according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve equivalent results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Referring now to the drawings, embodiments of the present disclosure are described below wherein like reference numerals designate identical or corresponding parts throughout the several views.

An image applier (image application system) according to a first embodiment of the present disclosure is described below with reference to FIGS. 1 to 5.

Figure 2:
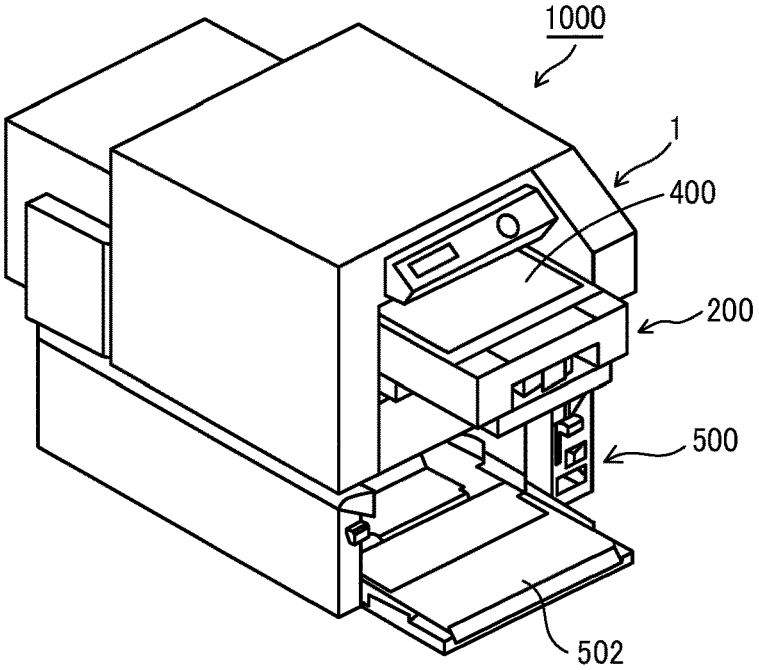
FIG. 2 is a perspective view of the image applier when a front cover of a heating device is opened after a printing process by a printer is finished.
Figure 3:
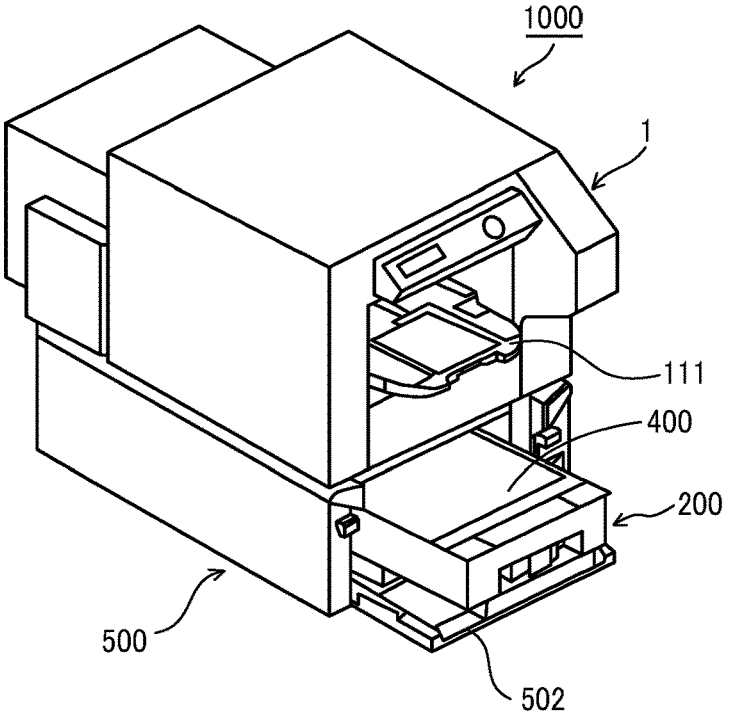
FIG. 3 is a perspective view of the image applier when a cassette is detached from the printer and is inserted into the heating device.
Figure 4:
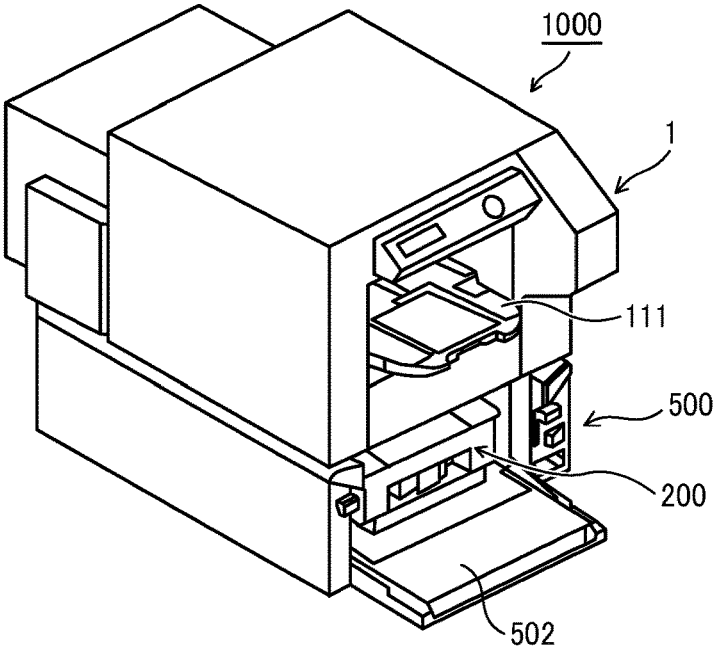
FIG. 4 is a perspective view of the image applier when the cassette is attached to the heating device.
Figure 5:
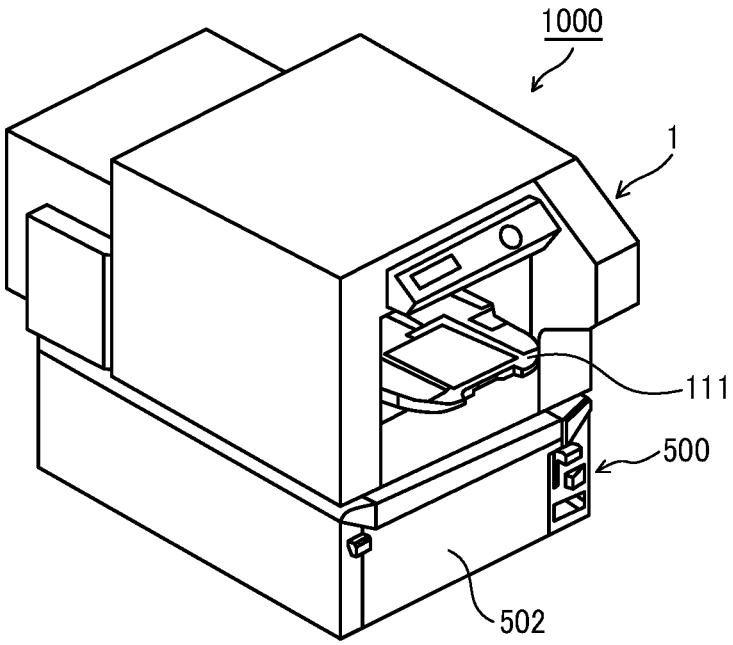
FIG. 5 is a perspective view of the image applier when the front cover of the heating device is closed and a fabric is heated.

FIG. 1 is a perspective view of the image applier when a cassette is mounted on a printer of the image applier for start printing. FIG. 2 is a perspective view of the image applier when a front cover of a heater is opened after the printing by the printer is finished. FIG. 3 is a perspective view of the image applier when a cassette is removed from the printer and is inserted into the heater. FIG. 4 is a perspective view of the image applier when the cassette is inserted into the heater. FIG. 5 is a perspective view of the image applier when the front cover of the heater is closed and the textile medium on which the image is printed is heated.

The image applier 1000 (image applying system) includes a cassette 200, a printer 1, and a heating device 500. The cassette 200 is a fabric holder that holds a portion to be printed of the fabric 400 in a flat state. The fabric 400 is the member (medium) to be printed. The cassette 200 is used for both the printer 1 and the heating device 500. The cassette 200 is detachably attachable to the printer 1 and prints an image on a fabric 400 held by the cassette 200. The cassette 200 is also detachably attachable to the heating device 500. The heating device 500 accommodates the fabric 400 together with the cassette 200 and heats the fabric 400 to fix the image on the fabric 400.

In FIG. 1, the printer 1 is mounted on the heating device 500. However, the printer 1 and the heating device 500 are separate bodies, so that the printer 1 and the heating device 500 may be arranged side by side or may be separated. The footprint of the image applier 1000 can be reduced by stacking the printer 1 and the heating device 500. In other words, the image applier 1000 can reduce the footprint of the image applier 1000 by stacking the printer 1 and the heating device 500.

As illustrated in FIG. 1, when the image applier 1000 prints the image on the fabric 400, the cassette 200 that holds the fabric 400 is set (mounted) on a stage 111 (see FIG. 3) of the printer 1.

As illustrated in FIG. 2, a front cover 502 of the heating device 500 is opened when a printing process of the image on the fabric 400 by the printer 1 is completed. Further, as illustrated in FIG. 3, the cassette 200 that holds the fabric 400 is removed from the printer 1 and is inserted into the heating device 500 in a state in which the cassette 200 holds the fabric 400. Then, as illustrated in FIG. 4, the heating device 500 accommodates the cassette 200 in the heating device 500. Then, as illustrated in FIG. 5, the front cover 502 of the heating device 500 is closed, and the fabric 400 is heated together with the cassette 200 by the heating device 500. The image printed on the fabric 400 is fixed to the fabric 400 by heating the fabric 400 with the heating device 500.

In this manner, the cassette 200 serving as the fabric holder can be shared by both the printer 1 and the heating device 500. Thus, the cassette 200 can be set inside the heating device 500 while the cassette 200 holds the fabric 400 in a state in which the image is printed on the fabric 400. Thus, an image on a printed surface of the fabric 400 is not disturbed by wrinkles or folds when the fabric 400 itself is moved. Thus, application of the image onto the fabric 400 is improved.

Figure 6:
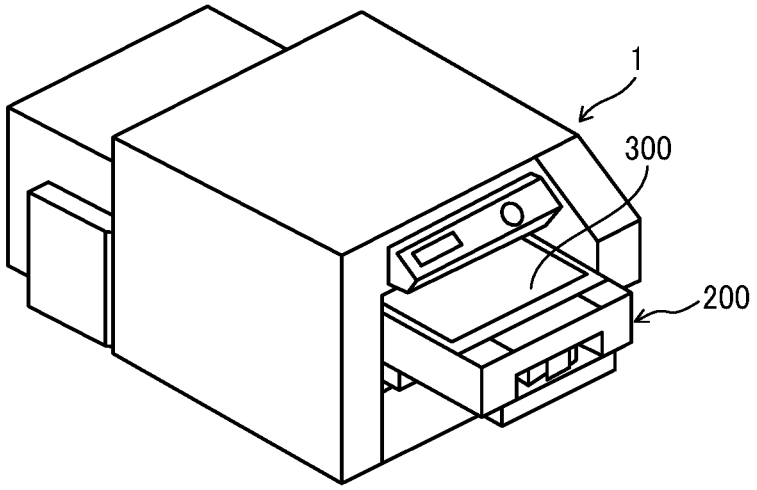
FIG. 6 is a perspective view of the printer when the printer mounts the cassette.
Figure 7:
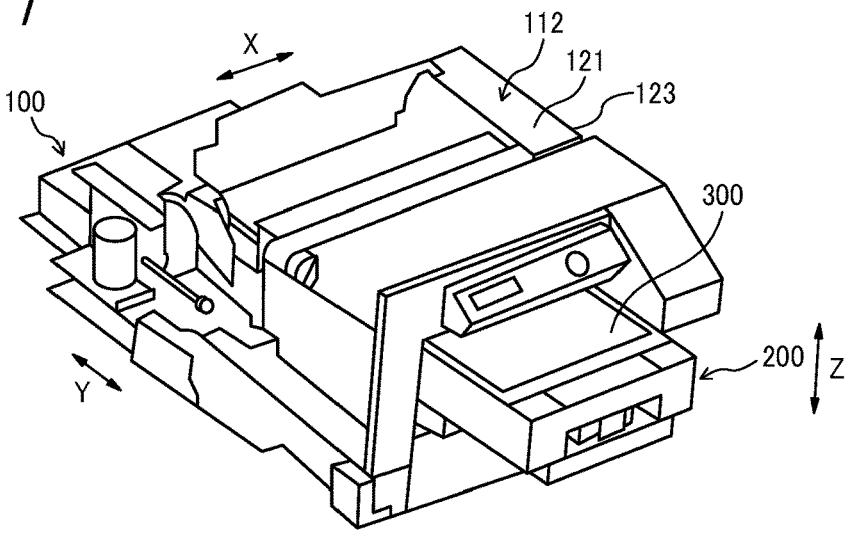
FIG. 7 is a perspective view of the printer from which an exterior is removed.
Figure 8A:
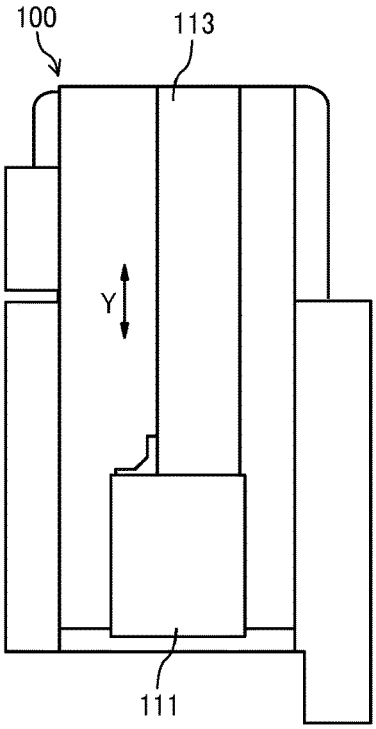
FIGS. 8A and 8B are plan views of a mechanism section below a head in a state in which a stage of the printer is at a detachment position.
Figure 8B:
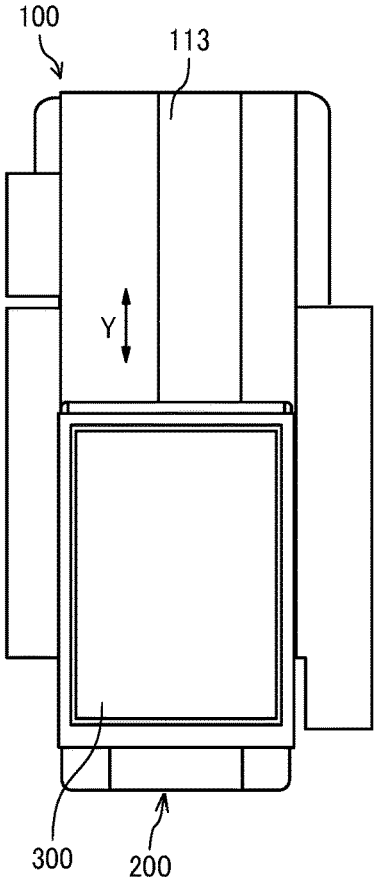
Figure 9A:
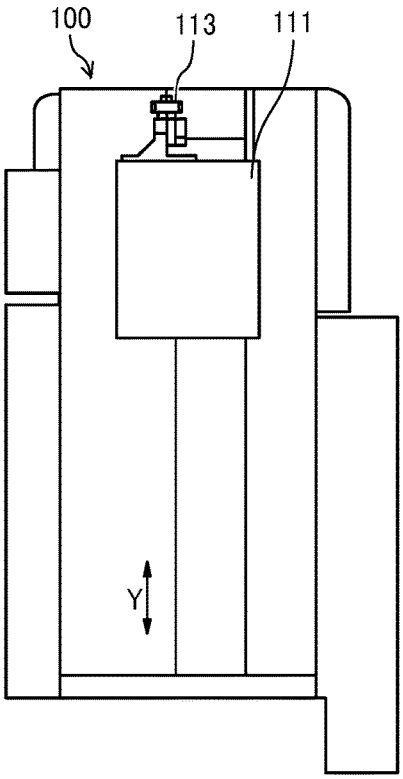
FIGS. 9A and 9B are plan views of a mechanism section below the head in a state in which the stage of the printer is at an innermost position.
Figure 9B:
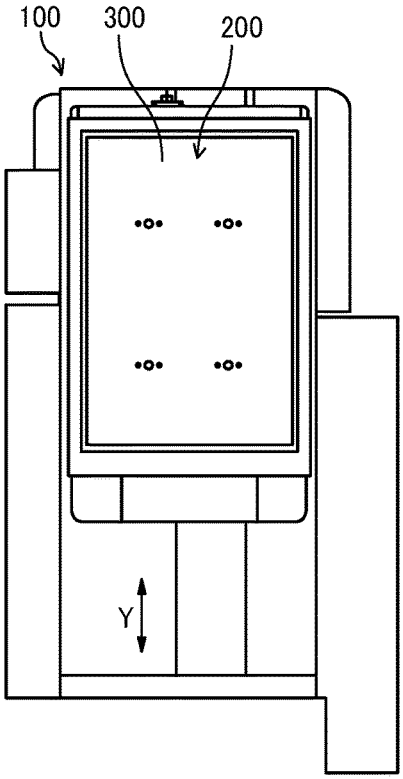

FIGS. 6 to 9B illustrate an example of the printer 1. FIG. 6 is a perspective view of the printer 1 when the printer mounts the cassette 200. FIG. 7 is a perspective view of the printer 1 when an exterior cover is removed from the printer 1. FIGS. 8A and 8B are plan views of mechanisms of the printer 1 below a liquid discharge head 123 in a state in which a stage of the printer 1 is at an attachment and detachment position. FIGS. 9A and 9B are plan views of mechanisms of the printer 1 below the liquid discharge head 123 in a state in which the stage of the printer 1 moves to an innermost position of the printer 1. FIGS. 8A and 9A illustrate the printer 1 when the printer 1 does not mount the cassette 200. FIGS. 8B and 9B illustrate the printer 1 when the printer 1 mounts the cassette 200. Further, the fabric 400 held by the cassette 200 is omitted in FIGS. 8A, 8B, 9A and 9B.

The printer 1 includes the stage 111 mentioned above and a printing section 112 in the apparatus body 100. The stage 111 is a receiver that moves back and forth while detachably holding the cassette 200. The stage 111 also serves as the fabric holder that holds the fabric 400 in place. The printing section 112 prints the image on the fabric 400 held by the cassette 200 that is held by the stage 111.

Here, not only the fabric 400 as a piece of cloth such as a handkerchief, or a towel, but also the fabric 400 processed as clothing, such as a T-shirt or a trainer, and a part of a product, such as a tote bag, can be, the fabric 400.

The stage 111 is disposed to be movable in a direction indicated by arrow Y (feeding direction) along a guide 113. The cassette 200 detachably attached to the stage 111 also moves in the Y-direction according to a movement of the stage 111.

The printing section 112 includes a carriage 121 that moves in a -direction indicated by arrow X (main scanning direction) with respect to the stage 111. The X-direction is perpendicular to the Y-direction. The carriage 121 includes the liquid discharge head 123. The liquid discharge head 123 discharges liquid from nozzles. Hereinafter, the liquid discharge head 123 is simply referred to as the "head 123". Although the printer 1 is an apparatus that forms images by an inkjet recording system, the printer 1 is not limited to an inkjet recording apparatus.

This printer 1 mounts and holds the cassette 200 on the stage 111 in the apparatus body 100 while the fabric 400 is set on a platen 300 of the cassette 200. Then, a required image is printed on the fabric 400 by repeating a reciprocal movement of the stage 111 in the Y-direction and a reciprocal movement of the printing section 112 (carriage 121) in an X-direction.

Here, the stage 111 can also be elevated and lowered in a vertical Z-direction. The printer 1 can adjust a gap between the fabric 400 and the head 123 to a predetermined gap by elevating and lowering the stage 111 according to a thickness of the fabric 400.

In this case, the printer 1 may print image on the fabric 400 while moving the stage 111 that mounts the cassette 200 from a position illustrated in FIGS. 8A and 8B to a position illustrated in FIGS. 9A and 9B. Further, the printer 1 may first move the stage 111 to the position illustrated in FIGS. 9A and 9B, and then print image on the fabric 400 while returning the stage 111 to the position illustrated in FIGS. 8A and 8B from the position illustrated in FIGS. 9A and 9B.

Figure 10:
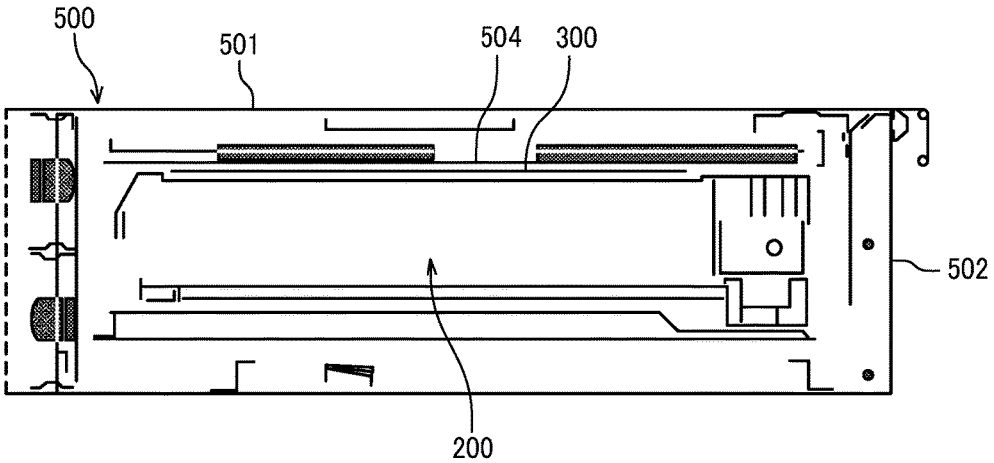
FIG. 10 is a cross-sectional view along a longitudinal direction of the heating device.
Figure 11:
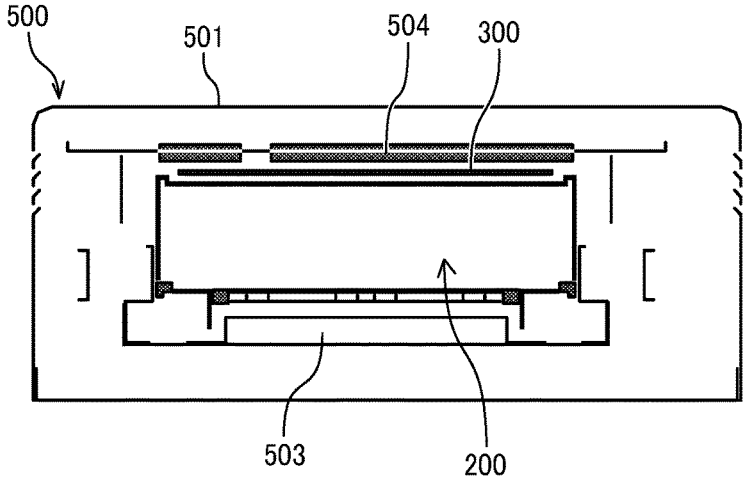
FIG. 11 is a cross-sectional view along the transverse direction of the heating device.

FIGS. 10 and 11 illustrate an example of the heating device 500. FIG. 10 is a cross-sectional view of the heating device 500 along a longitudinal direction (attachment and detachment direction of the cassette 200) of the heating device 500. Here, the longitudinal direction of the heating device 500 is along an attachment and detachment direction of the cassette 200 to and from the heating device 500 indicated by arrow AD in FIG. 12. FIG. 11 is a cross-sectional view of the heating device 500 along a transverse direction (perpendicular to the attachment and detachment direction AD of the cassette 200) of the heating device 500. The transverse direction is perpendicular to the longitudinal direction of the heating device 500

The heating device 500 includes a receiver 503 and a heater 504. The receiver 503 detachably mounts the cassette 200 that holds the fabric 400 inside an apparatus body 501. Here, "mount" includes simply putting the cassette 200 in the apparatus body 501. The heater 504 heats the fabric 400 held by the cassette 200. The heater 504 is a heating means for heating the fabric 400.

The heater 504 faces the platen 300 of the cassette 200 and heats the fabric 400 held on the platen 300 in a contact or non-contact manner.

A planar member formed of a material having excellent thermal conductivity such as aluminum may be provided on the cassette 200 side of the heater 504. Thus, the heater 504 with the planar member heats the fabric 400 such that a surface temperature of the fabric 400 becomes substantially uniform from the heat generated by the heater 504. In this way, the heating device 500 can heat the fabric 400 at approximately the same temperature in a plane (along a surface) of the fabric 400 regardless of the heating position of the heater 504.

Figure 12:
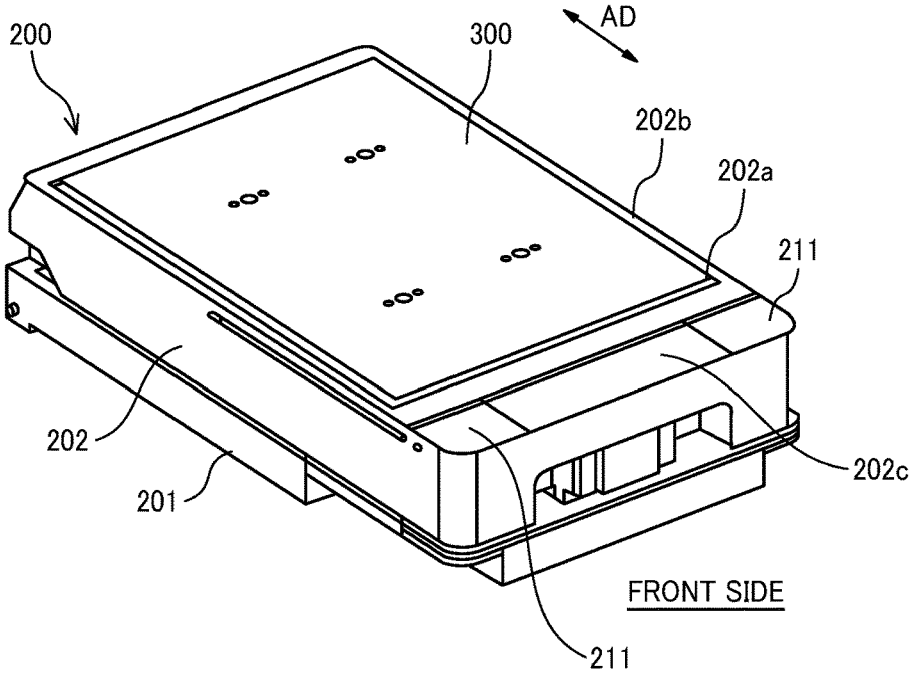
FIG. 12 is a perspective view of the cassette as a fabric holder according to a first embodiment of the present disclosure.

Next, a cassette as the fabric holder is described with reference to FIG. 12. FIG. 12 is a perspective view of the cassette 200.

The cassette 200 includes a base 201, the platen 300, and a peripheral cover 202. The platen 300 holds flat the portion of the fabric 400 on which an image is to be printed. The fabric 400 is sandwiched and held between the peripheral cover 202 and the platen 300.

The peripheral cover 202 includes a frame 202*b* and a contactable portion 202*c*. The frame 202*b* forms an opening 202*a* where the platen 300 is exposed. The contactable portion 202*c* is a portion held by hand when the cassette 200 is detached from and attached to the printer 1 and the heating device 500.

The peripheral cover 202 further includes a heat insulator 211 having a thermal conductivity lower than a thermal conductivity of the peripheral cover 202. The heat insulator 211 is disposed at both ends of the front side of the cassette 200 in the X-direction perpendicular to the attachment and detachment direction AD (Y-direction) of the cassette 200. The contactable portion 202*c* is disposed at the front side of the cassette 200 in the attachment and detachment direction AD (Y-direction) of the cassette 200. The contactable portion 202*c* includes the heat insulator 211.

Fibrous members can be used as the heat insulator 211, for example. Thus, the heat insulator 211 may be made of fiber, for example, nylon, polyester, rayon, cotton, or the like, implanted on a surface of the peripheral cover 202 by electrostatic implantation.

The cassette 200 thus configured enables an area of the heat insulator 211 to be grasped when the cassette 200 is detached from the heating device 500 after the fabric 400 is heated by the heating device 500. Thus, the cassette 200 can be quickly detached from the heating device 500, thereby improving the heating process of the heating device 500.

As described above, after the image is printed on the fabric 400 by the printer 1, the fabric 400 held by the cassette 200 is set together with the cassette 200 in the heating device 500 to heat the fabric 400 with the heating device 500.

Here, the heating device 500 heats the fabric 400 without contacting the fabric 400 to dry and fix the ink onto the fabric 400. Thus, the heating device 500 uses a non-contact method that does not contact the fabric 400 during heating the fabric 400. Heating the fabric 400 using the non-contact method can heat a region wider than an area of the platen 300 heated by a contact method in which a heater is pressed only on a specific area of the platen 300 (fabric 400). Although the heating the fabric 400 for heating and fixing ink onto the fabric 400 after the printing is described above, the heating process may be applied to heating during pretreatment that heats the fabric 400 before printing for increasing the flatness of the ink on the fabric 400.

The heating device 500 heats the fabric 400 together with the cassette 200 at a high temperature until the ink on the fabric 400 is dried. Thus, at the time immediately after the ink is fixed on the fabric 400, a portion of the cassette 200 other than the platen 300 also becomes considerably hot. In particular, when a material of the peripheral cover 202 of the cassette 200 is metal or resin, a surface of the cassette 200 (surface at a same side of a surface of the platen 300) becomes considerably hot.

Thus, the cassette 200 cannot be detached from the heating device 500 until the temperature of the cassette 200 decreases to some extent, which results in lost time. Although a post-treatment that heats and fixes ink onto the fabric 400 after the printing is described above, the above described heating process may be applied to the pre-treatment in which the fabric 400 is heated before the printing for increasing the flatness of the ink on the fabric 400.

Thus, providing the heat insulator 211 in a handle portion (a portion held by the hand) of the cassette 200 can increase the temperature of a portion held by the hand when the cassette 200 is detached from the heating device 500. For example, if metal is felt hot above 55° C. and plastic is felt hot above 85° C., there are members which do not feel hot near 200° C. since the fiber (heat insulator 211) has a lower thermal conductivity than metal and plastic.

Thus, the cassette 200 can be detached from the heating device 500 without waiting for a decrease in the overall temperature of the cassette 200, thereby reducing lost time.

Figure 13:
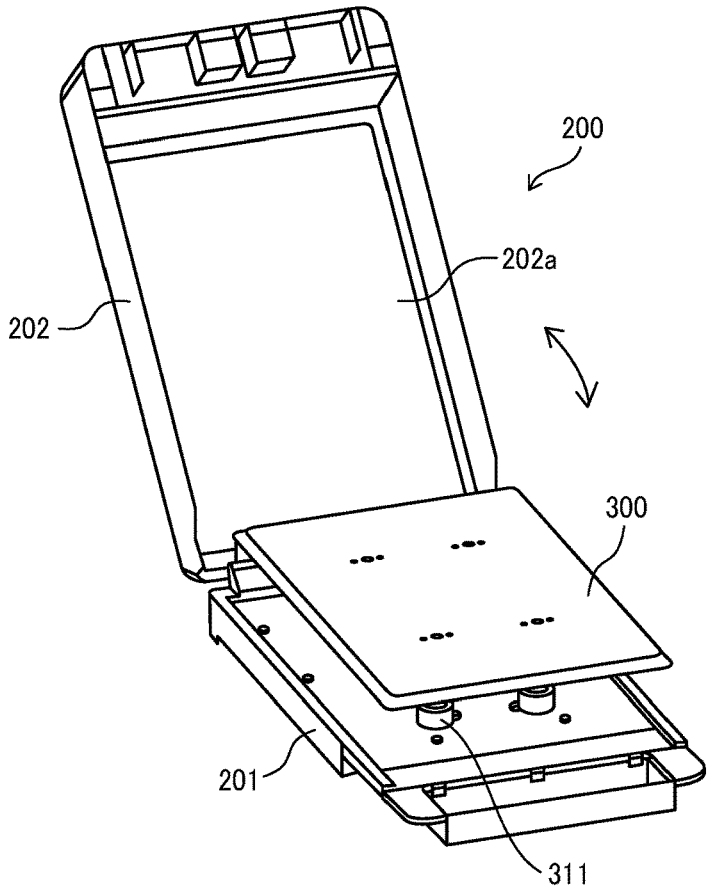
FIG. 13 is a perspective view of the cassette in which the peripheral cover of the cassette is opened.
Figure 14:
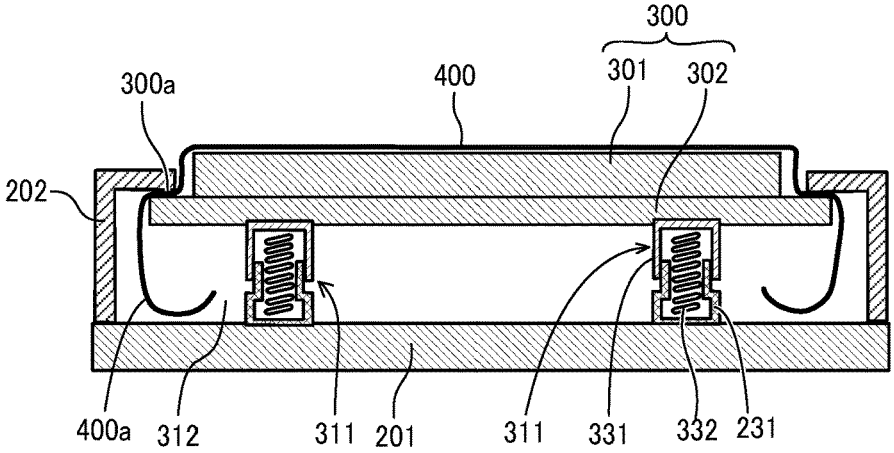
FIG. 14 is a cross-sectional view of the cassette along the transverse direction of the cassette.

FIGS. 13 and 14 illustrate a detailed configuration of the cassette 200. FIG. 13 is a perspective view of the cassette 200 in which the peripheral cover 202 of the cassette 200 is opened. FIG. 14 is a cross-sectional view of the cassette 200 along the transverse direction (X-direction, see FIG. 7) of the cassette.

The platen 300 includes a platen structure 302 and a heat insulator 301 constituting a surface for holding the fabric 400 in a flat state. The heat insulator 301 has heat resistance against heating by the heating device 500.

The peripheral cover 202 includes a hinge or the like, openably closable with respect to the base 201 in a direction indicated by an arrow in FIG. 13. As illustrated in FIG. 14, the fabric 400 is sandwiched and pressed between the peripheral cover 202 and a flange 300*a* of a peripheral portion of the platen 300.

The platen 300 is supported on a base 201 by a support 311. An accommodation space 312 is formed between the platen 300 and the base 201 to accommodate a surplus portion 400*a* of the fabric 400. When printing is performed on a front side of a T-shirt, for example, the surplus portion 400*a* corresponds to the sleeves, the collar, and the skirt of the T-shirt, for example.

Here, the platen 300 is detachable from the base 201 to be exchanged. Thus, a plurality of platens 300 may be prepared, and clothes may be previously wound around other platens 300 during the printing process. Printing of the next fabric 400 can be promptly started merely by replacing the platen 300 after completion of the previous printing process and the fixing (heating) process.

The support 311 supporting the platen 300 includes a hollow support 231 disposed on a base 201 side, a hollow support 331 movably fitted to the hollow support 231, and a compression spring 332 disposed between the hollow supports 231 and 331. The hollow support 331 is disposed on the platen 300 side Thus, the platen 300 is supported on the base 201 to be displaceable with the base 201. Therefore, a distance between the platen 300 and the base 201 is changed according to a change in a thickness of the fabric 400 such that the platen 300 descends against a restoring force of the compression spring 332. Thus, the cassette 200 of the present embodiment can correspond to fabrics 400 having different thickness.

FIGS. 15 to 18 illustrate a procedure of setting the fabric 400 to the cassette 200. FIGS. 15 to 18 are perspective views illustrating a setting operation of the fabric 400 on the cassette 200.

Figure 15:
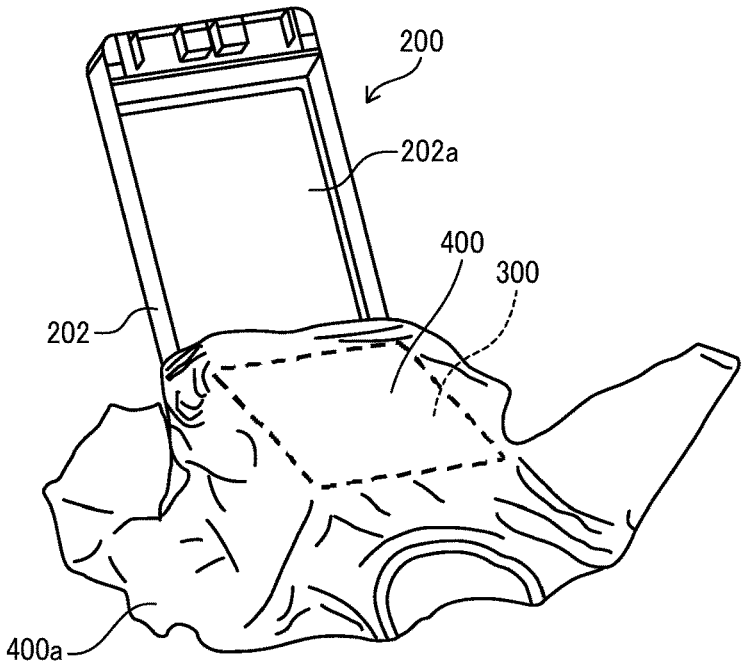
FIG. 15 is a perspective view of the cassette illustrating a procedure of setting a fabric to the cassette.
Figure 16:
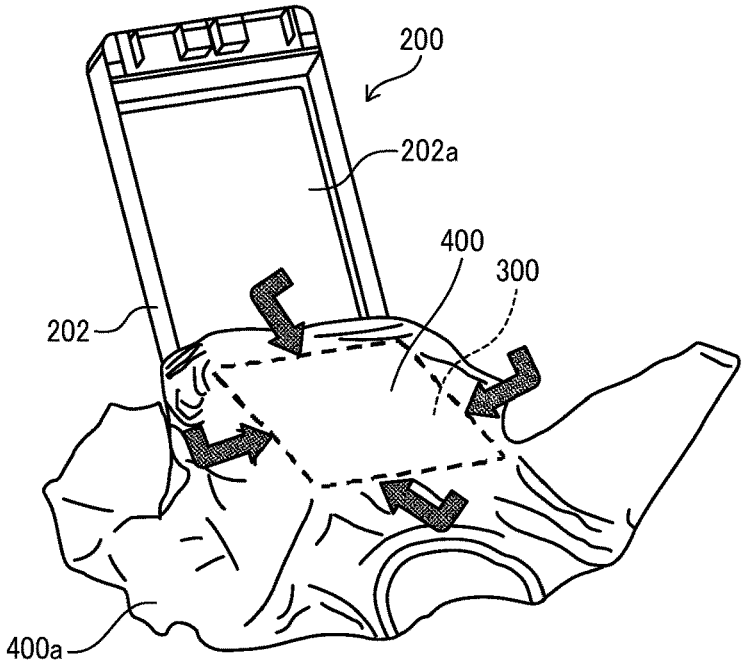
FIG. 16 is a perspective view of the cassette illustrating a procedure following FIG. 15.
Figure 17:
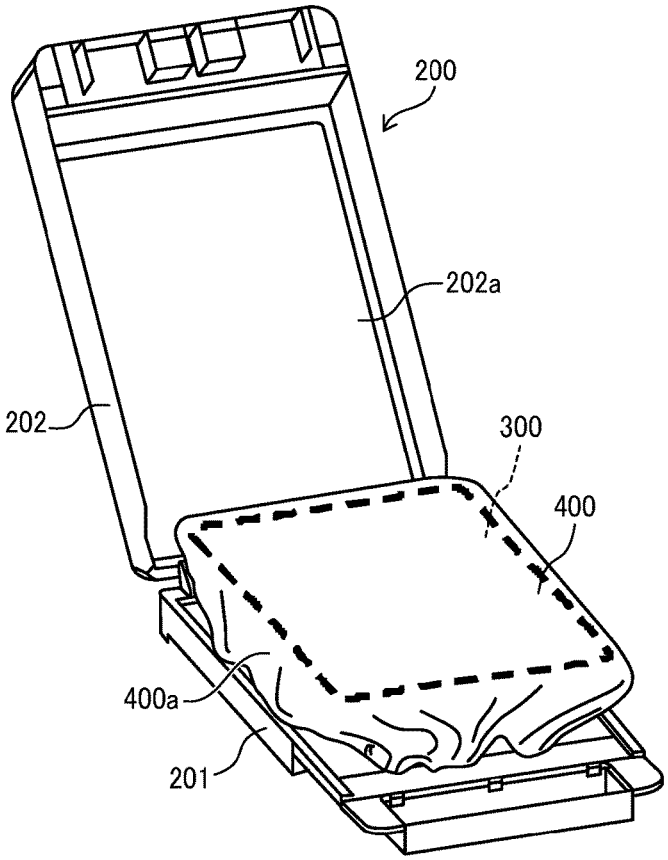
FIG. 17 is a perspective view of the cassette illustrating a procedure following FIG. 16.
Figure 18:
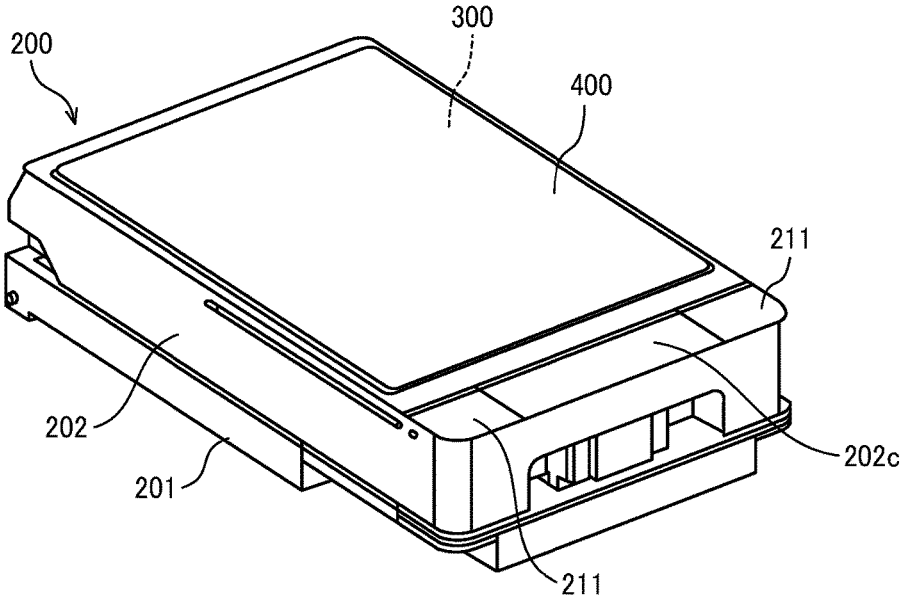
FIG. 18 is a perspective view of the cassette illustrating a procedure following FIG. 17.

As illustrated in FIG. 15, when setting the fabric 400 on the cassette 200, the peripheral cover 202 is opened, and the portion of the fabric 400 to be printed is placed on the platen 300. Then, as illustrated in FIG. 16, the surplus portion 400*a* of the fabric 400 is pushed into the accommodation space 312 in a direction indicated by arrow. Thus, the surplus portion 400*a* is accommodated inside the accommodation space 312 as illustrated in FIG. 17. Then, as illustrated in FIG. 18, the peripheral cover 202 is closed.

As a result, a printed portion of the fabric 400 is held flat by the platen 300. The surplus portion 400*a* of the fabric 400 is accommodated in the cassette 200 without protruding outside the heating device 500.

Figure 19:
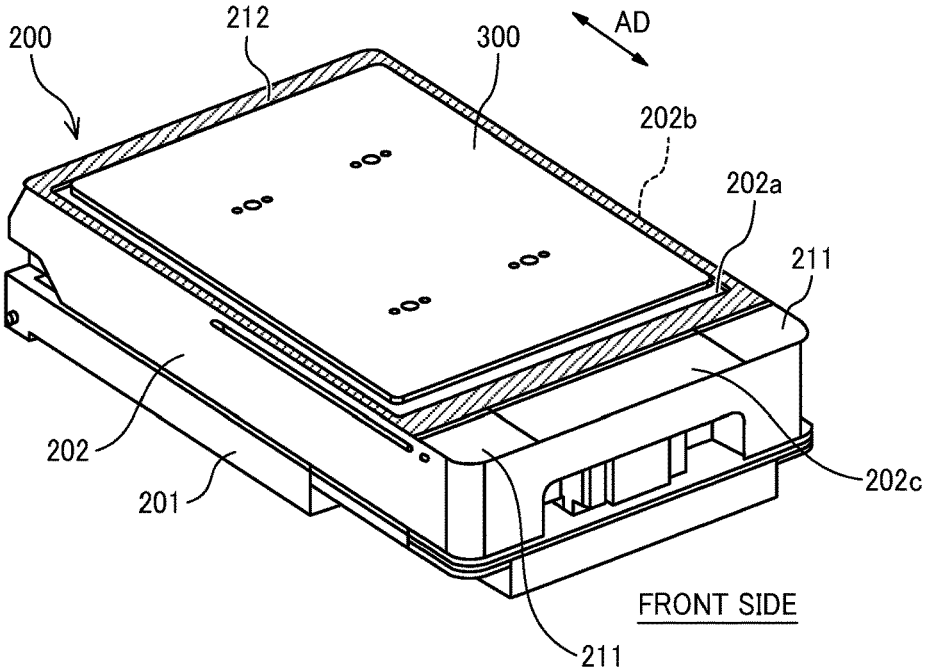
FIG. 19 is a perspective view of the cassette as a fabric holder according to a second embodiment of the present disclosure.

A cassette 200 according to a second embodiment of the present disclosure is described below with reference to FIG. 19. FIG. 19 is a perspective view of the cassette 200.

This cassette 200 includes a heat insulator 212 provided also on a surface of the frame 202*b* of the peripheral cover 202.

When the fabric 400 is heated by the non-contact method as described above, the surface of the peripheral cover 202 is also heated, in particular, the frame 202*b* surrounding an outer periphery of the platen 300 becomes hotter than the contactable portion 202*c*.

Therefore, the cassette 200 according to the present embodiment includes the heat insulator 212 also on a surface of the frame 202*b* so that the cassette 200 can be detached from the heating device 500 by contacting the surface of the frame 202*b* without causing discomfort.

The heat insulator 212 may be the same type of member (for example, fiber) as the heat insulator 211, or it may be a different member. However, the heat insulator 212 is preferably made of a member having higher heat resistance than the heat insulator 211 since the heat insulator 212 is closer to a heating area of the heating device 500. Further, a color of the heat insulator 212 is preferably different from a color of the heat insulator 211 so that the heat insulator 211 can be clearly understood to be a handle portion.

Figure 20:
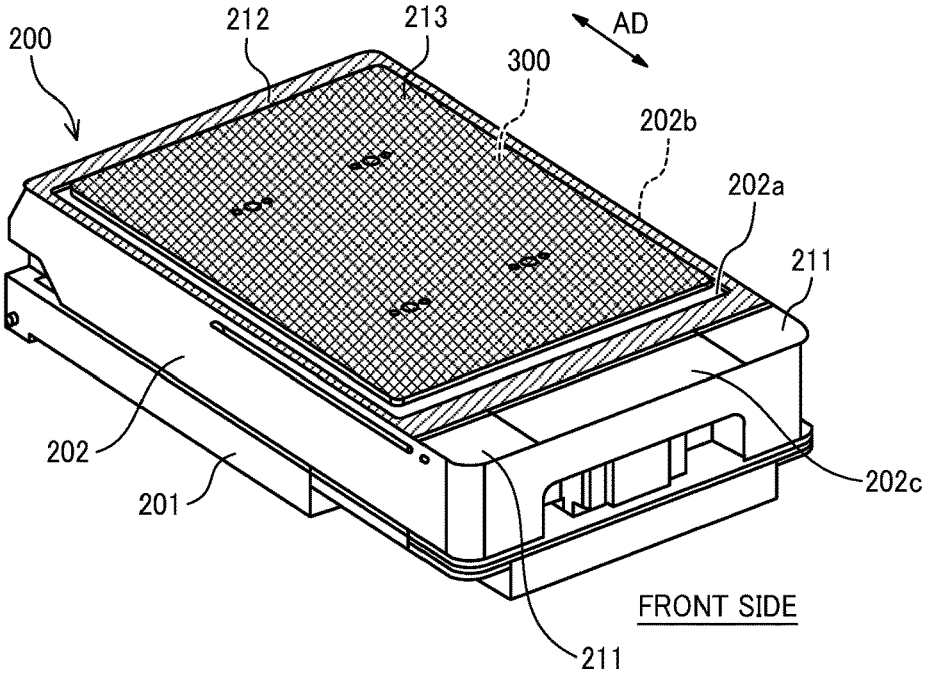
FIG. 20 is a perspective view of the cassette as a fabric holder according to a third embodiment of the present disclosure.

A cassette 200 according to a third embodiment of the present disclosure is described below with reference to FIG. 20. The cassette 200 is a fabric holder. FIG. 20 is a perspective view of the cassette 200.

The cassette 200 of the third embodiment includes a heat insulator 213 on a surface of a portion of the platen 300 where the portion of the fabric 400 to be printed is held flat (a portion corresponding to the heat insulator 301 of the first embodiment).

Thus, the cassette 200 of the third embodiment can reduce the cost as compared with a configuration in which entire of the platen 300 is made of a heat insulator.

Figure 21:
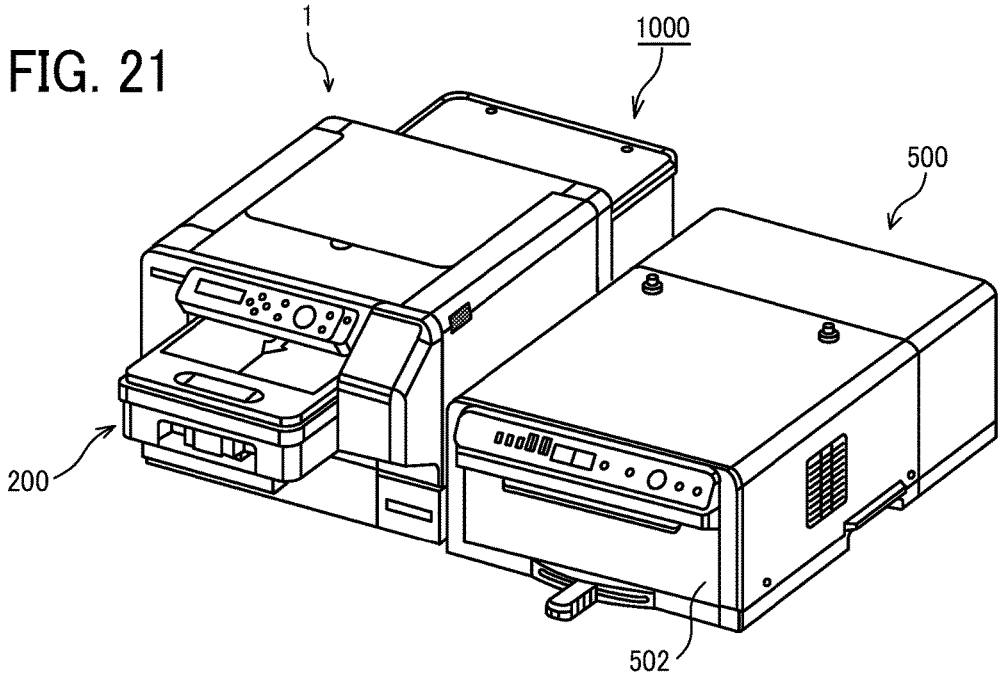
FIG. 21 is a perspective view of the image applier (image application system) according to a fourth embodiment of the present disclosure.
Figure 22:
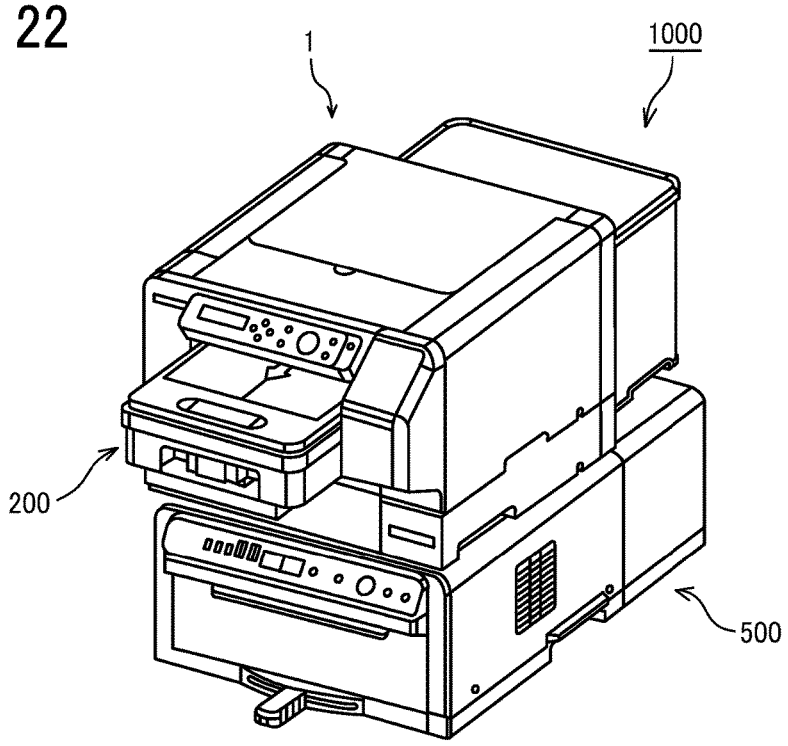
FIG. 22 is a perspective view of another formation of the image applier according to the fourth embodiment.

FIGS. 21 and 22 illustrate an image applier (image application system) according to a fourth embodiment of the present disclosure. FIG. 21 is a perspective view of one of formation of the image applier according to the fourth embodiment. FIG. 22 is a perspective view of another formation of the image applier according to the fourth embodiment.

The image applier (image application system) 1000 includes a cassette 200, a printer 1, and a heating device 500. The cassette 200 is detachably attachable to the printer 1 that prints an image on a fabric 400 held by the cassette 200. The cassette is a fabric holder to hold the fabric 400. The heating device 500 accommodates the cassette 200 holding the fabric 400, and heats the fabric 400. The heating device 500 includes heating means such as a heater 504 in the heating device 500 as described above. Further, the heating device 500 uses the heating device 500 of the fifth embodiment to be described below.

Here, the printer 1 and the heating device 500 are arranged side by side in the image applier 1000 illustrated in FIG. 21. Further, the printer 1 and the heating device 500 are stacked one above the other in the image applier 1000 illustrated in FIG. 22. In FIG. 21, although the printer 1 is stacked on the heating device 500, the heating device 500 may be stacked on the printer 1.

Figure 23:
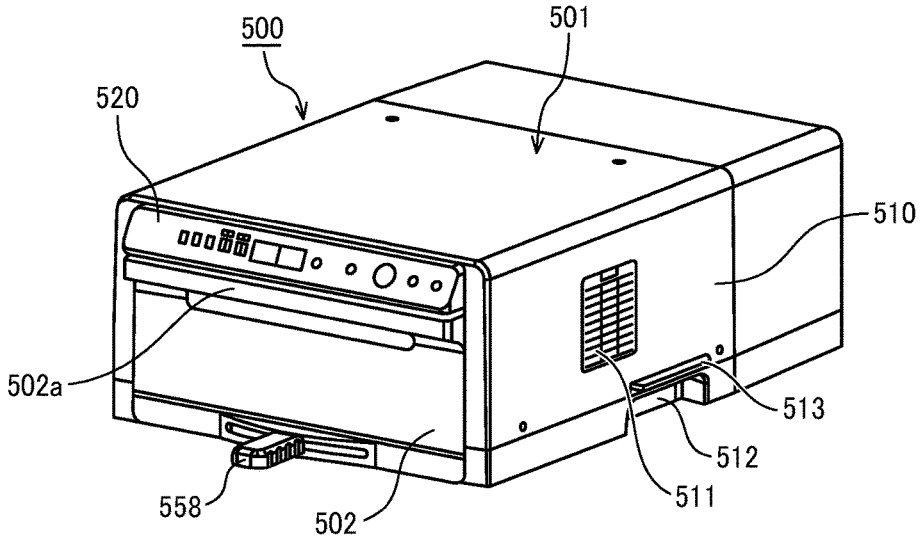
FIG. 23 is an external perspective view of the heating device according to a fifth embodiment of the present disclosure.
Figure 24:
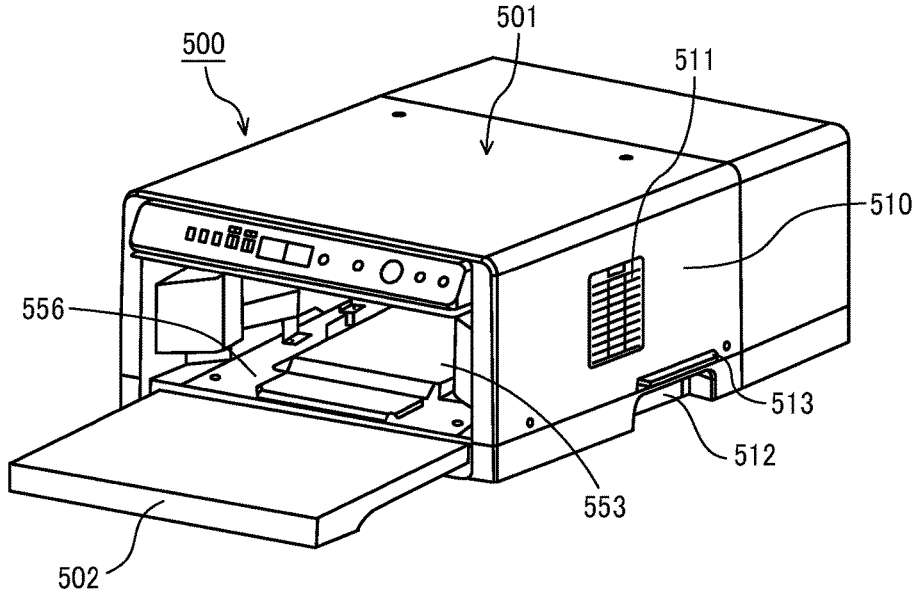
FIG. 24 is a perspective view of the heating device in a state in which the front cover of the heating device is opened.
Figure 25:
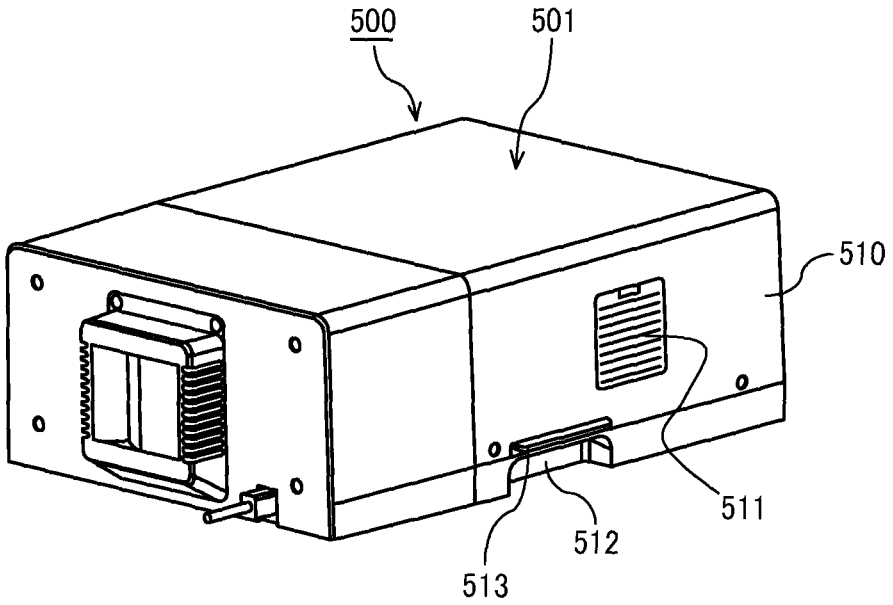
FIG. 25 is a perspective view of the heating device as viewed from a rear side of the heating device.

The heating device 500 according a fifth embodiment of the present disclosure is described below with reference to FIGS. 23 to 25. FIG. 23 is an external perspective view of the heating device 500. FIG. 24 is a perspective view of the heating device 500 in a state in which the front cover of the heating device 500 is opened. FIG. 25 is a perspective view of the heating device 500 as viewed from a rear side of the heating device 500.

This heating device 500 includes an openably closable front cover 502 on a front face of the apparatus body 501. The heating device 500 further includes a table 553 and a heater for heating the fabric 400 such as the heater 504 in FIG. 11 in the apparatus body 501. The table 553 serves as a receiver on which the cassette 200 holding the fabric 400 is placed.

A handle 502*a* is provided on the front cover 502 for opening and closing the front cover 502. A control panel 520 of the heating device 500 is disposed above the front cover 502.

Then, as described above, the cassette 200 holding the fabric 400 is accommodated inside the apparatus body 501 of the heating device 500 to heat the fabric 400. Further, the cassette 200 holding the fabric 400 is usable in the printer 1 that prints the image on the fabric 400 held by the cassette 200. The cassette 200 (fabric holder) holding the fabric (400) is detachable from and attachable to the printer 1 and the heating device 500.

Figure 26:
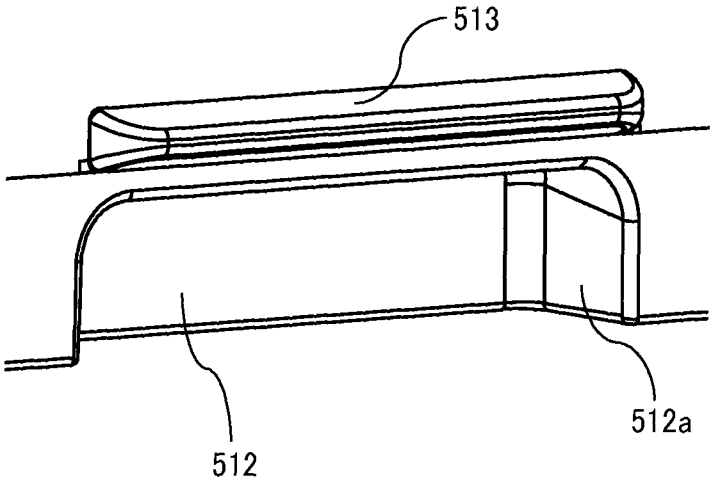
FIG. 26 is an enlarged perspective view of a handle of the heating device.
Figure 27:
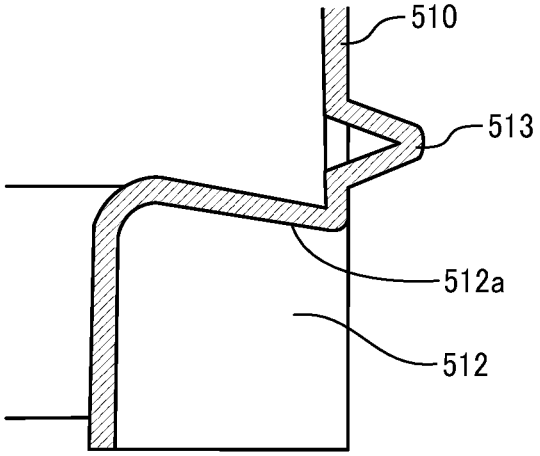
FIG. 27 is a cross-sectional view of the handle of the heating device.

Next, an exterior structure of the heating device 500 according to the fifth embodiment is described with reference also to FIGS. 26 and 27. FIG. 26 is an enlarged perspective view of a handle 512 of the heating device 500. FIG. 27 is a cross-sectional view of the handle 512.

As illustrated in FIG. 25, exhaust ports 511 communicating with an interior of the apparatus body 501 are provided on both side surfaces of an exterior 510 that configures the apparatus body 501 of the heating device 500.

As illustrated in FIGS. 25 and 26, a recess 512*a* is provided in a surface of the exterior 510 on which the exhaust port 511 is provided. The recess 512*a* becomes the handle 512 used for carrying the heating device 500. Further, a ridge 513 is provided above the recess 512*a* (handle 512) and is formed along the recess 512*a*. Although the ridge 513 is integrally formed with the exterior 510, alternatively the ridge 513 may be formed separately from the exterior 510 and attached to the exterior 510.

Figure 28:
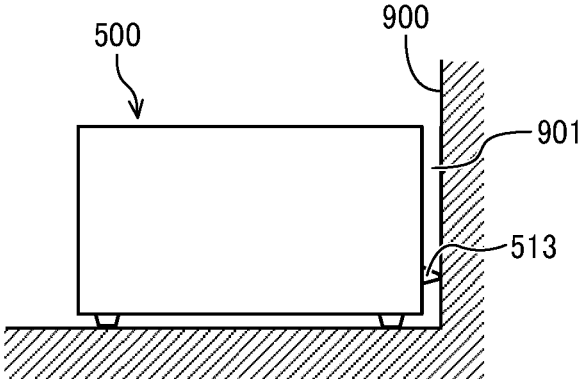
FIG. 28 is a side view of the heating device according to the fifth embodiment during installation.

As illustrated in FIG. 28, a gap 901 is secured between the exterior 510 and a wall surface 900 even when the heating device 500 is installed close to the wall surface 900. The size of the gap 901 corresponds to the height of the ridge 513 protruding from a surface of the exterior 510.

Thus, as illustrated in FIG. 28, the heating device 500 can exhaust air inside the heating device from the exhaust ports 511 because a gap 901 is secured between one of the exhaust ports 511 and a wall surface 900 even when the heating device 500 is installed close to the wall surface 900.

The ridge 513 enables the user to hold the cassette 200 by placing four fingers other than the thumb on the recess 512*a* constituting the handle 512 and placing the thumb on the ridge 513 so that the user can grasp the ridge 513 and an upper surface of the recess 512*a*. Thus, the ridge 513 enables the user to stably carry the heating device 500.

Figure 29:
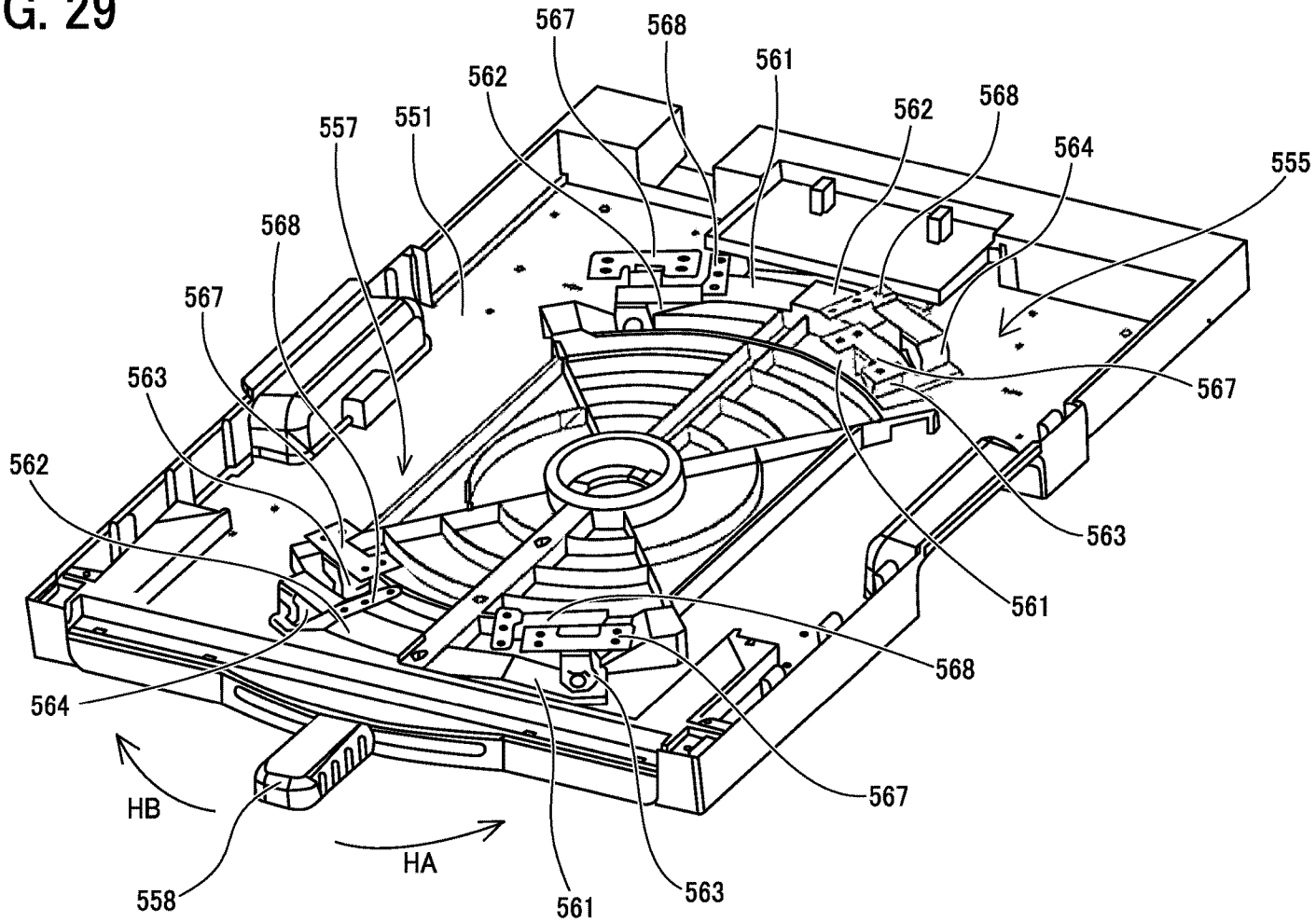
FIG. 29 is a perspective view of a vertical mover of the heating device.
Figure 30:
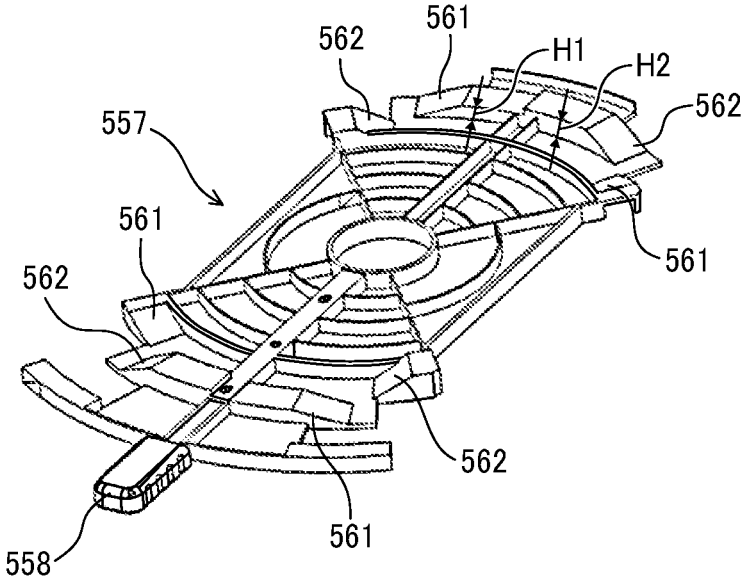
FIG. 30 is a perspective view of a cam mechanism of the vertical mover.

The fifth embodiment also includes a vertical mover of the heating device 500, now described with reference also to FIGS. 29 and 30. FIG. 29 is a perspective view of the vertical mover of the heating device 500. FIG. 30 is a perspective view of a cam mechanism 557 of the vertical mover.

The table 553 (see FIG. 24) is held on a table vertical mover 555.

The table vertical mover 555 includes a holding table 556 (see FIG. 24) that holds the table 553 and the cam mechanism 557 that vertically moves the holding table 556.

The cam mechanism 557 includes a mode switching lever 558 that is a vertical operation lever rotatably held in a horizontal direction on a bottom plate 551 of the apparatus body 501. The mode switching lever 558 includes a first inclined cam 561 and a second inclined cam 562 having different heights. As illustrated in FIG. 30, a height of the uppermost surface of the first inclined cam 561 is lower than a height of the uppermost surface of the second inclined cam 562.

The table vertical mover 555 includes a first roller 563, a first inclined cam 561, a second roller 564, a second inclined cam 562, and roller holders 567 and 568 fixed on a bottom surface of the holding table 556. The first roller 563 follows the first inclined cam 561. The second roller 564 follows the second inclined cam 562. The roller holders 567 and 568 rotatably hold the first roller 563 and the second roller 564. The holding table 556 is held on the cam mechanism 557 via the first roller 563 and the second roller 564.

Here, as illustrated in FIG. 29, the mode switching lever 558 is rotated in a direction indicated by arrow HA with respect to an initial position where the mode switching lever 558 positions at a center. Then, the first roller 563 rides on the first inclined cam 561 so that the holding table 556 is raised to a height H1.

Similarly, the mode switching lever 558 is rotated in the direction indicated by arrow HB from the initial position. Then, the second roller 564 rides on the second inclined cam 562 so that the holding table 556 is raised to a height H2 where the height H2 is larger than the height H1 (H2>H1).

In this way, the holding table 556 moves vertically by operating (rotating) the mode switching lever 558. Thus, a height of the cassette 200 placed on the table 553 held on the holding table 556 also changes. Therefore, an operation (rotation) of the mode switching lever 558 can change a gap or a pressing force between the fabric 400 and the heating means (heater 504 in FIG. 11, for example).

Operating (rotating) the mode switching lever 558 in the direction indicated by arrow HB enables a wrinkle removal (pre-processing) mode in which the heating means (heater 504) is pressed against the fabric 400 held by the cassette 200 that is held by the holding table 556 at the height H2 so that wrinkles in the fabric 400 can be removed. Further, operating (rotating) the mode switching lever 558 in the direction indicated by arrow HA enables a drying (post-processing) mode in which the heating means (heater 504) is separated from the fabric 400 (becomes non-contact state) held by the cassette 200 that is held by the holding table 556 at the height H1 so that the fabric 400 is heated by the heating means in non-contact state.

Figure 31:
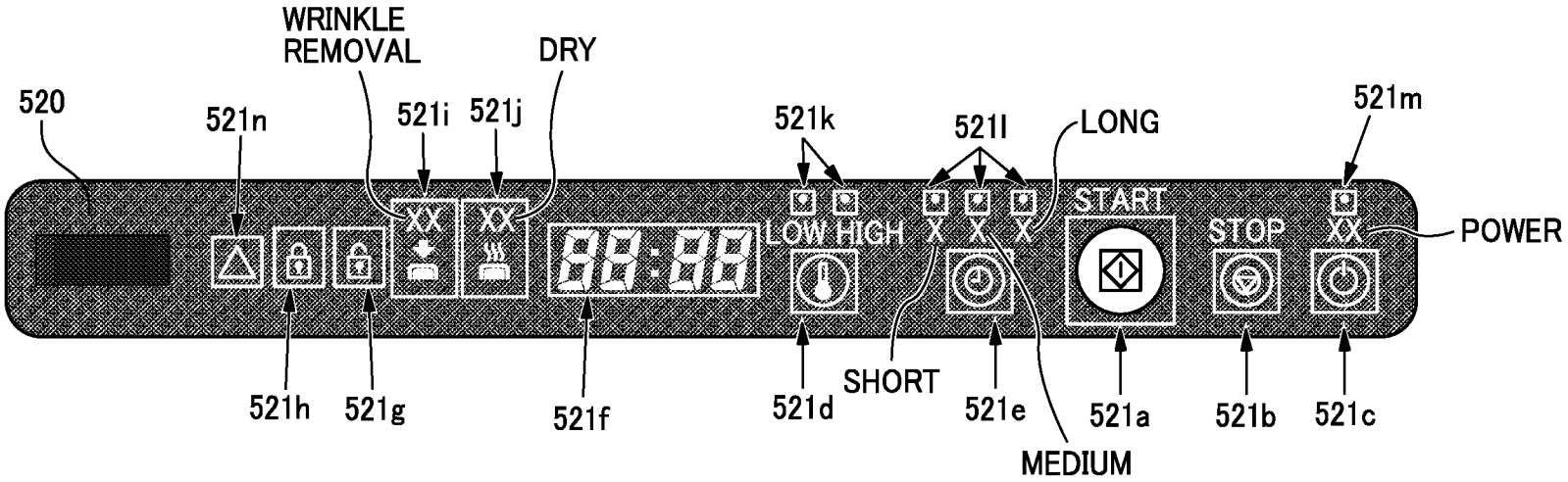
FIG. 31 illustrates a control panel of the heating device.

Next, an example of a control panel 520 of the heating device 500 according to the fifth embodiment is described with reference to FIG. 31. FIG. 31 illustrates the control panel 520.

The control panel 520 includes a start button (key) 521*a*, a stop button 521*b*, a power button 521*c*, a set-temperature switching button 521*d*, a heating time setting button 521*e*, and a countdown indicator 521*f*. The start button 521*a* instructs to start a heating operation. The stop button 521*b* instructs to stop the heating operation. The countdown indicator 521*f* indicates countdown of operation time of the heating device 500.

Further, the control panel 520 includes a lock indicator 521*g* and an unlock indicator 521*h*. The lock indicator 521*g* indicates a lock state (in operation) of the front cover 502, and an unlock indicator 521*h* indicates an unlocked state of the front cover 502.

Further, the control panel 520 includes a wrinkle removal mode indicator 521*i* and a drying mode indicator 521*j*. The wrinkle removal mode indicator 521*i* indicates that a wrinkle removal mode (pre-treatment mode) is selected. The drying mode indicator 521*j* indicates that a drying mode (post-treatment mode) is selected.

Further, the control panel 520 includes a temperature indicator 521*k*, a time indicator 521*l*, a power indicator 521*m*, and a high temperature indicator 521*n*, for example.

Figure 32:
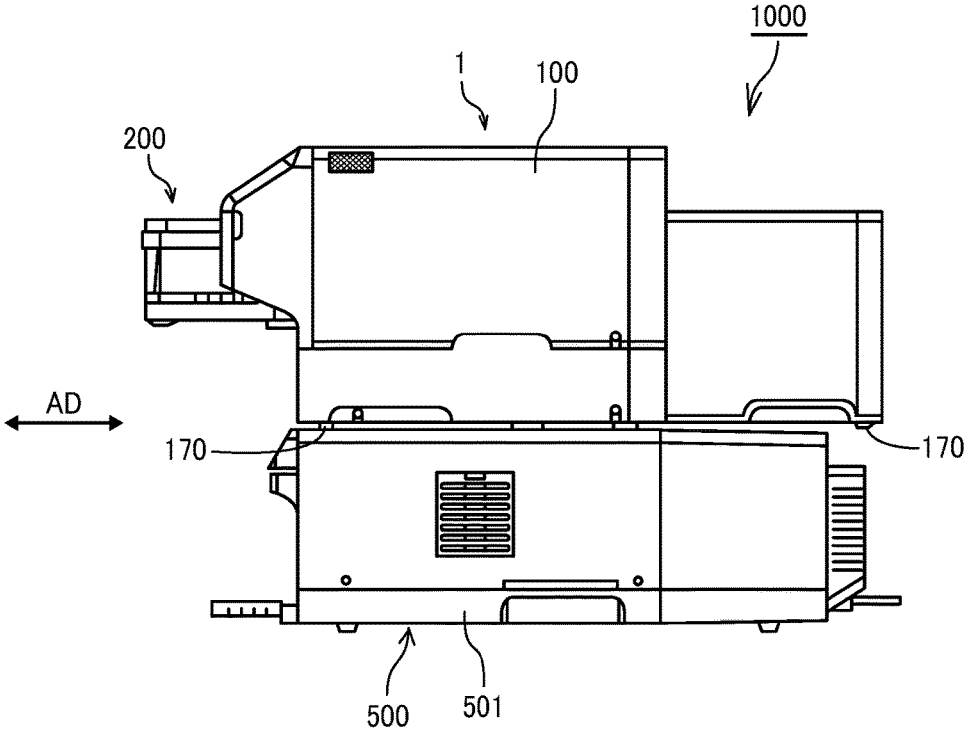
FIG. 32 is a side view of the image applier according to a sixth embodiment of the present disclosure.
Figure 33:
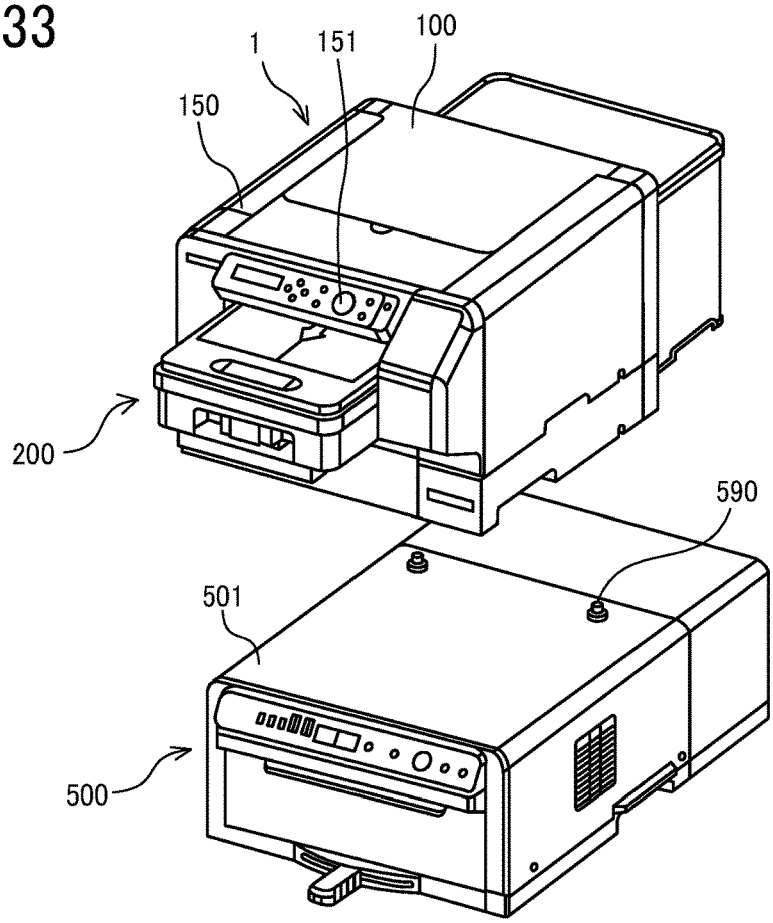
FIG. 33 is a perspective view of the image applier in a state in which the printer and the heating device are vertically separated.
Figure 34:
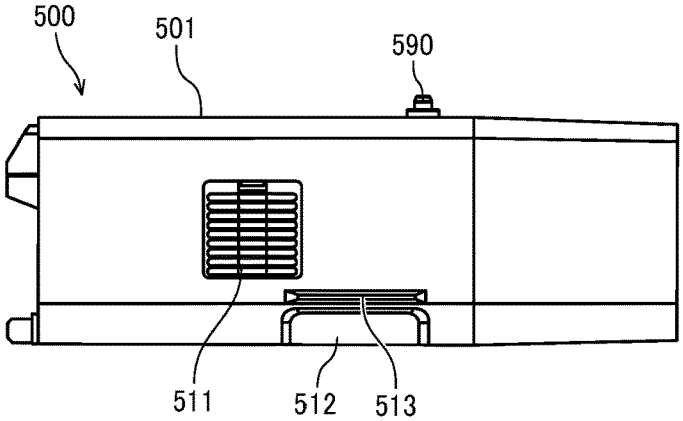
FIG. 34 is a side view of the heating device alone.

Next, the image applier 1000 according to a sixth embodiment of the present disclosure is described with reference to FIGS. 32 to 34. FIG. 32 is a side view of the image applier 1000. FIG. 33 is a perspective view of the image applier 1000 in a state in which the printer 1 and the heating device 500 are vertically separated. FIG. 34 is a side view of the heating device 500 alone.

This image applier 1000 has a configuration in which the printer 1 is stacked on a joined to the heating device 500.

Here, a length of the printer 1 is longer than a length of the heating device 500 in the attachment and detachment direction AD of the cassette 200. As illustrated in FIG. 32, feet 170 are arranged at four corners on a lower surface of the printer 1 for installation of the printer 1 on the heating device 500. Thus, the feet 170 of a rear side of the printer 1 position where the feet 170 do not contact the heating device 500 when the printer 1 is stacked on the heating device 500. Here, a detachment side of the cassette 200 corresponds to a front side of the cassette 200.

In this case, the feet 170 of the printer 1 may be arranged to be rest on a top surface of the apparatus body 501 of the heating device 500. However, it is preferable to install the four corners of an apparatus body 100 of the printer 1 on an installation surface when the printer 1 is used alone. A total of six numbers of the feet 170 may be provided on the printer 1 so that four feet 170 are placed on the top surface of the apparatus body 501 of the heating device 500. In this case, the printer 1 may not be installed on an installation surface (top surface) of the heating device 500 that has a convex portion 590 at a position corresponds to a center portion of the printer 1.

Thus, the present disclosure has a configuration in which the feet 170 on the front side of the printer 1 is directly rest on the top surface of the apparatus body 501 of the heating device 500. A central portion of the printer 1 includes convex portions 590 on the top surface of the apparatus body 501 of the heating device 500. Thus, the convex portions 590 of the heating device 500 are fitted into concave portions 190 (see FIG. 39 described below) provided on the lower surface of the apparatus body 100 of the printer 1.

Figure 35:
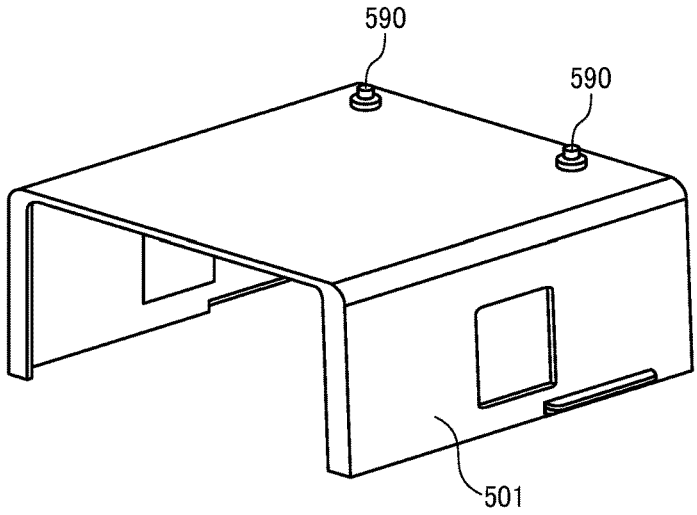
FIG. 35 is a perspective view of a part of heating device illustrating a coupling structure of the printer and the heating device according to the sixth embodiment.
Figure 36:
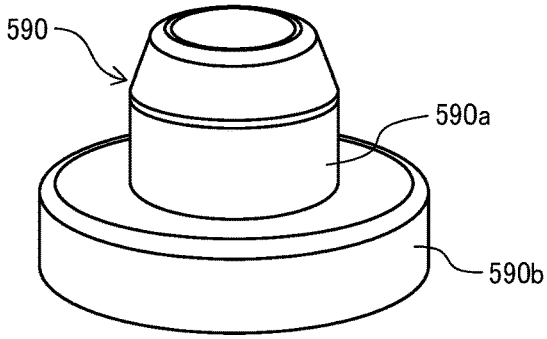
FIG. 36 is a perspective view of a convex portion to be attached to the heating device.
Figure 37:
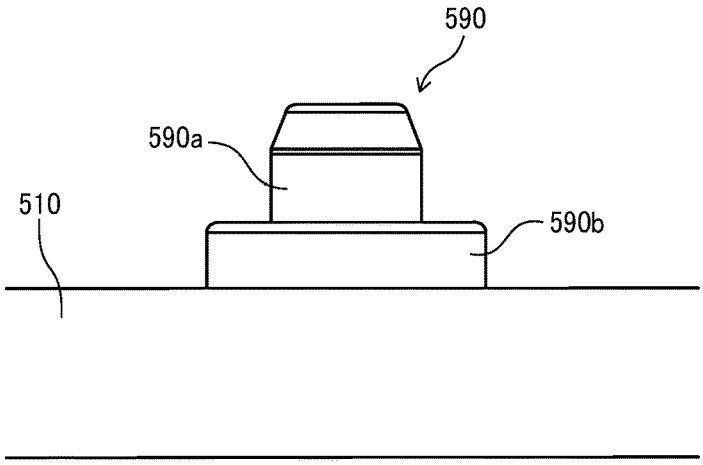
FIG. 37 is an enlarged side view of the convex portion attached to the heating device.
Figure 38:
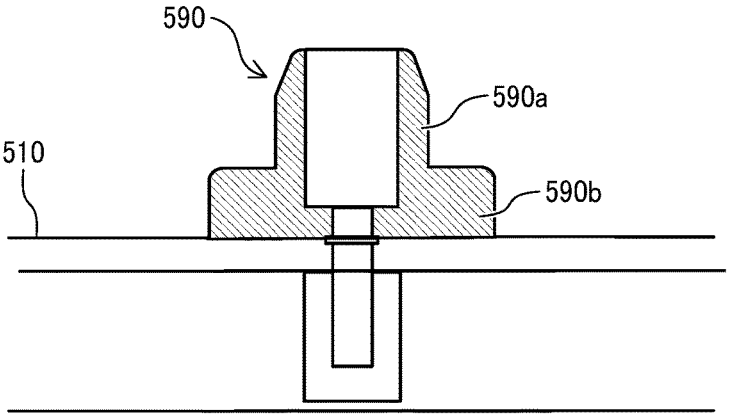
FIG. 38 is a cross-sectional view of the convex portion attached to the heating device.
Figure 39:
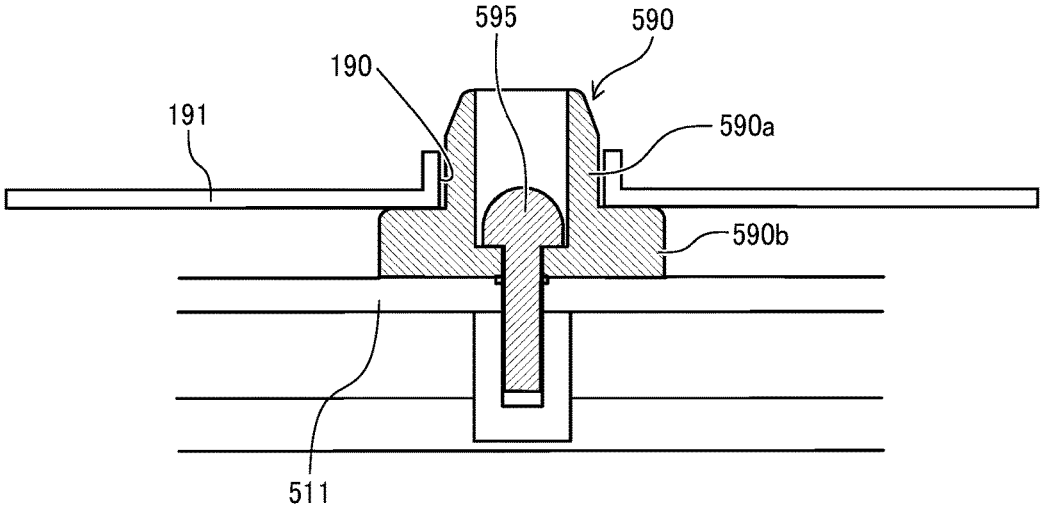
FIG. 39 is a cross-sectional view of a portion of concave and convex coupling in a state in which the printer and the heating device are stacked.

Next, a coupling structure of the printer 1 and the heating device 500 in the sixth embodiment is described with reference also to FIGS. 35 to 39. FIG. 35 is a perspective view of a part of the heating device 500. FIG. 36 is a perspective view of the convex portion 590 to be attached to the heating device. FIG. 37 is an enlarged side view of a portion of the heating device 500 to which the convex portion 590 is attached. FIG. 38 is a cross-sectional view of a portion of the heating device 500 to which the convex portion 590 is attached. FIG. 39 is a cross-sectional view of a portion of concave and convex coupling in a state in which the printer 1 and the heating device 500 are stacked.

As illustrated in FIG. 35, the convex portions 590 are provided at two positions on the top surface of the apparatus body 501 of the heating device 500. The convex portions 590 include a fitting portion 590*a* and a reception portion 590*b*. The fitting portion 590*a* and the reception portion 590*b* constitute a two-stage structure. The fitting portion 590*a* is inserted into the concave portion 190 provided in a bottom plate (bottom surface) 191 of the apparatus body 100 of the printer 1. The reception portion 590*b* has a diameter larger than a diameter of the fitting portion 590*a*. Here, a shape of the fitting portion 590*a* and the reception portion 590*b* are not limited to a circle. The reception portion 590*b* receives the bottom plate 191 (bottom surface) of the apparatus body 100 of the printer 1. The convex portions 590 and the concave portions 190 constitute the coupling portion.

Here, the convex portions 590 are separate member from the exterior 510 of the apparatus body 501 and are fixed to the exterior 510 with screws 595. Therefore, when the convex portion 590 is unnecessary, the convex portion 590 can be removed as illustrated in FIG. 23.

In the heating device 500 thus configured, the fitting portion 590*a* of the convex portion 590 of the heating device 500 is fitted into the concave portion 190 of the printer 1 when the printer 1 is stacked on the heating device 500, Thus, the printer 1 can be stably mount the printer 1 on the heating device 500. Further, the concave and convex coupling of the convex portion 590 and the concave portion 190 can prevent the printer 1 from falling off from the heating device 500.

Further, the convex portion 590 may be disposed on one of a top surface of the heating device 500 and a bottom surface (bottom plate 191) of the printer 1, and the concave portion (190) may be disposed on another of the top surface of the heating device 500 and the bottom surface (bottom plate 191) of the printer 1.

A coupling structure between the printer 1 and the heating device is not limited to the concave and convex coupling as described above. For example, it is possible to adopt a configuration in which a guide portion such as a guide rail, a guide groove, etc. is provided on one top surface, and an engaging portion is provided so as to be engaged with a guide portion on the other and movable so as to be movable.

Next, an image application process on the fabric 400 using the image applier 1000 according to the sixth embodiment is described. Here, the image applier 1000 includes the printer 1 as described in the first embodiment as illustrated in FIGS. 1 to 18 and the heating device 500 as described in the fifth embodiment as illustrated in FIGS. 23 to 25.

First, the fabric 400 is set in the cassette 200.

Next, pre-processing for removing wrinkles on a printed portion of the fabric 400 is performed. In the pre-treatment, following processes are performed.

(1-1) The front cover 502 of the heating device 500 is opened. Then, the cassette 200 is placed on the table 553 and is accommodated in the apparatus body 501.

(1-2) The mode switching lever 558 of the heating device 500 is operated (rotated in the direction indicated by the arrow HB in FIG. 29) to switch to the pre-treatment mode. As a result, the table 553 moves up to a position where the fabric 400 held by the cassette 200 comes into contact with the heater 504 inside the heating device 500.

(1-3) The start button 521*a* is pressed to start a heating process in a state in which a power of the control panel 520 is on.

(1-4) After completion of the heating process, the front cover 502 is opened, and the cassette 200 is taken out (detached) from the heating device 500.

As a result of this pre-treatment, the printed portion of the fabric 400 is heated while the printed portion is in contact with the heating means including the heater 504, so that wrinkles are removed and a printing area of the fabric 400 is flattened.

Next, a printing process for printing image on the fabric 400 is performed. In the printing process, following processes are performed.

(2-1) The cassette 200 holding the fabric 400 to which the pre-treatment has been performed is mounted on the stage 111 of the printer 1.

(2-2) The start button 151 of the control panel 150 (see FIG. 33) of the printer 1 is pressed to start a printing process.

(2-3) After completion of the printing process, the cassette 200 is detached (taken out) from the printer 1.

Next, post-treatment for fixing a printed result on the fabric 400 is performed. In post-treatment, following processes are performed.

(3-1) The front cover 502 of the heating device 500 is opened. Then, the cassette 200 holding the fabric 400 to which the printing process is performed is placed on the table 553 and is accommodated in the heating device 500.

(3-2) The mode switching lever 558 of the heating device 500 is operated (rotated in the direction of the arrow HA in FIG. 29) to switch to the post-treatment mode. As a result, the table 553 moves up to a position where the fabric 400 held by the cassette 200 does not contact the heater 504 inside the heating device 500.

(3-3) The start button 521*a* is pressed to start a heating process in a state in which a power of the control panel 520 is on.

(3-4) After completion of the heating process, the front cover 502 is opened, and the cassette 200 is detached from the heating device 500.

In this manner, the fabric 400 is heated in a non-contact state with the heating means including the heater 504. Thus, a printing result (printed image) can be fixed to the fabric 400 without causing the heater 504 or the like to come into contact with a printing surface of the fabric 400 and to disturb the printing result.

Here, stacking the printer 1 and the heating device 500 can improve the workability of detaching the cassette 200 from the printer 1 to which the printing process has been performed and setting the cassette 200 in the heating device 500 when the cassette 200 to which the pre-treatment process has been performed is detached from the heating device 500 and is mounted on the stage 111 of the printer 1.

In this case, it is preferable to stack and install the printer 1 and the heating device 500 so that the attachment and detachment direction AD of the cassette 200 from and to the printer 1 and the heating device 500 are identical.

Thus, the workability is further improved by simply moving the cassette 200 from the bottom to the top or from the top to the bottom to attach or detach the cassette 200 to or from the printer 1 and the heating device 500.

Figure 40:
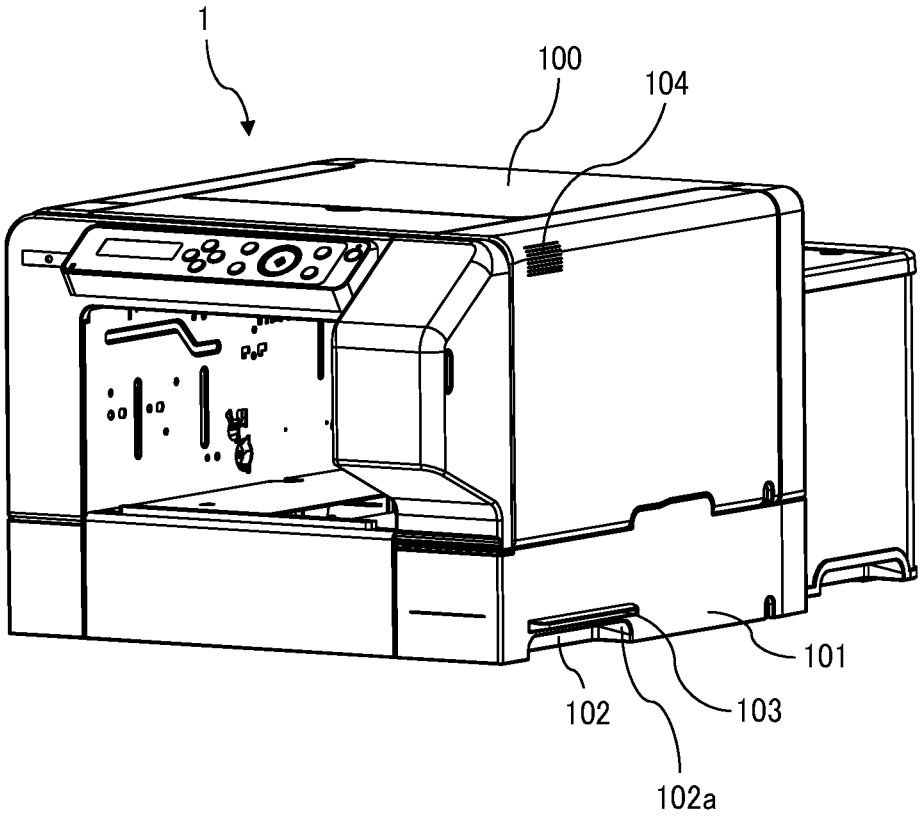
FIG. 40 is a schematic front view of a printer according to a seventh embodiment of the present disclosure.

A printer 1 according to a seventh embodiment of the present disclosure is described with reference to FIG. 40. FIG. 40 is an external perspective view of the printer 1.

The printer 1 includes an exhaust port 104 on a surface of an exterior 101 that configures the apparatus body 100. A recess 102*a* is provided on a surface of the exterior 101 on which the exhaust port 104 is provided. The recess 102*a* serves as a handle 102, used when the printer 1 is transported. Further, a ridge 103 is provided above the recess 102*a* (handle 102) and is formed along the recess 102*a*. Although the ridge 103 is formed integrally with the exterior 101, the ridge 103 provided separately with the exterior 101 may be attached to the exterior 101.

The printer 1 thus configured can be stably transported by grasping the recess 102*a* of the handle 102 and the ridge 103 when transporting the printer 1.

A fabric is mainly described in the above embodiment. However, the present disclosure may be similarly applied to the case where the object to be printed or the object to be heated is a medium. In this case, the "fabric" in the above embodiment is the medium. In addition, the member to be printed including fabric and media.

Further, a configuration in which the handle and the ridge are provided may be applied to any devices without particularly limited as long as the device is portable.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A fabric holder comprising:

a platen to hold a portion of a fabric to be printed;

a peripheral cover including a frame to sandwich the fabric between the platen and the frame, the fabric holder being detachably attachable to a printer to perform printing on the fabric held by the fabric holder and a heating device that heats the fabric held by the fabric holder after the printer has performed printing on the fabric held by the fabric holder, and the peripheral cover including a heat insulator having a thermal conductivity lower than a thermal conductivity of the peripheral cover.

2. The fabric holder according to claim 1, further comprising a contactable portion on a front side of the peripheral cover, wherein the contactable portion includes the heat insulator.

3. The fabric holder according to claim 2, wherein the frame of the peripheral cover includes the heat insulator on a surface of the frame.

4. The fabric holder according to claim 3, wherein a heat resistance of the heat insulator of the frame is higher than a heat resistance of the heat insulator of the contactable portion.

5. The fabric holder according to claim 3, wherein a color of the heat insulator of the frame is different from a color of the heat insulator of the contactable portion.

6. The fabric holder according to claim 1, wherein the heat insulator is made of a fiber.

7. The fabric holder according to claim 1, further comprising:

a base to support the platen, and a space formed between the platen and the base to accommodate a surplus portion of the fabric.

8. A heating device for accommodating the fabric holder according to claim 1, the heating device comprising a heater to heat the fabric held by the fabric holder.

9. The heating device according to claim 8, farther comprising:

an exhaust port disposed on a surface of an exterior of the heating device;

a recess provided on a surface of the exterior on which the exhaust port is provided; and a ridge provided above the recess along the recess.

10. An image applier comprising:

a printer to perform printing on the fabric held by the fabric holder; and the fabric holder according to claim 1.

11. The image applier according to claim 10, wherein the printer includes a receiver detachably bolding the fabric holder.

12. The image applier according to claim 11, wherein the printer further comprises:

an exhaust port disposed on a surface of an exterior of the printer;

a recess provided on a surface of the exterior on which the exhaust port is provided; and a ridge provided above the recess along the recess.

13. The image applier according to claim 10, wherein the printer is stacked on the heating device.

14. The image applier according to claim 13, wherein an attachment and detachment direction of the fabric holder to and from the printer and the heating device are identical.

15. The image applier according to claim 13, further comprising a coupling portion to detachably couple the printer and the heating device.

16. The image applier according to claim 15, wherein the coupling portion includes a convex portion and a concave portion into which the convex portion is fitted, the convex portion is disposed on one of a top surface of the heating device and a bottom surface of the printer, and the concave portion is disposed on another of the top surface of the heating device and the bottom surface of the printer.

17. The image applier according to claim 16, wherein the convex portion includes a reception portion to receive the bottom surface of the printer and a fitting portion formed on the reception portion to be fitted into the concave portion.

18. The fabric holder according to claim 1, wherein the heating device and the printer each include receiving areas shaped to receive the fabric holder.

19. A heating device for accommodating a fabric holder, the heating device comprising a heater to heat a fabric held by the fabric holder, the fabric holder comprising:

a platen to hold a portion of the fabric to be printed;

a peripheral cover including a frame to sandwich the fabric between the platen and the frame, wherein the fabric holder is detachably attachable to a heating device that heats the fabric, and the peripheral cover includes a heat insulator having a thermal conductivity lower than a thermal conductivity of the peripheral cover;

the heating device-further comprising:

an exhaust port disposed on a surface of an exterior of the heating device;

a recess provided on a surface of the exterior on which the exhaust port is provided; and a ridge provided above the recess along the recess.

20. An image applier comprising:

a printer to perform printing on a fabric held by a fabric holder; and the fabric holder comprising:

a platen to hold a portion of a fabric to be printed;

a peripheral cover including a frame to sandwich the fabric between the platen and the frame, wherein the fabric holder is detachably attachable to a heating device that heats the fabric, and the peripheral cover includes a heat insulator having a thermal conductivity lower than a thermal conductivity of the peripheral cover;

wherein the fabric holder holding the fabric is detachable from and attachable to the printer and the heating device; and wherein the printer is stacked on the heating device.

* * * * *